US011781537B2

(12) United States Patent
Guo et al.

(10) Patent No.: US 11,781,537 B2
(45) Date of Patent: Oct. 10, 2023

(54) RADIAL PISTON HYDRAULIC DEVICE DISTRIBUTED BY PILOT OPERATED CHECK VALVES

(71) Applicant: HUAQIAO UNIVERSITY, Quanzhou (CN)

(72) Inventors: Tong Guo, Quanzhou (CN); Tao Luo, Quanzhou (CN); Tianliang Lin, Quanzhou (CN); Qihuai Chen, Quanzhou (CN); Haoling Ren, Quanzhou (CN); Cheng Miao, Quanzhou (CN); Shengjie Fu, Quanzhou (CN)

(73) Assignee: HUAQIAO UNIVERSITY, Quanzhou (CN)

( * ) Notice: Subject to any disclaimer, the term of this patent is extended or adjusted under 35 U.S.C. 154(b) by 0 days.

(21) Appl. No.: 17/880,611

(22) Filed: Aug. 3, 2022

(65) Prior Publication Data

US 2023/0042317 A1 Feb. 9, 2023

(30) Foreign Application Priority Data

Aug. 3, 2021 (CN) ..... 202110885537.0

(51) Int. Cl.
*F04B 1/0465* (2020.01)
*F04B 1/0408* (2020.01)
*F04B 53/16* (2006.01)

(52) U.S. Cl.
CPC ..... *F04B 1/0465* (2013.01); *F04B 1/0408* (2013.01); *F04B 53/16* (2013.01)

(58) Field of Classification Search
CPC ..... F04B 1/0465; F04B 1/0408; F04B 53/16
See application file for complete search history.

(56) References Cited

U.S. PATENT DOCUMENTS 4,785,714 A * 11/1988 Tamada ..... F04B 49/02 91/499
9,377,020 B2 * 6/2016 Armstrong ..... F04C 14/10
2004/0101417 A1 * 5/2004 Arai ..... F04B 49/125 91/491
2014/0271244 A1 * 9/2014 Gray, Jr. ..... F04B 1/0435 417/443
2023/0235757 A1 * 7/2023 Guo ..... F15B 15/1409 60/327

* cited by examiner

*Primary Examiner* — Connor J Tremarche

(57) ABSTRACT

A radial piston hydraulic device distributed by pilot operated check valves includes a housing, a plurality of piston assemblies, a main shaft, the rotating shaft, first pilot operated check valves having a same number with the plurality of piston assemblies and one-to-one corresponding to the plurality of piston assemblies, and second pilot operated check valves having a same number with the plurality of piston assemblies and one-to-one corresponding to the plurality of piston assemblies. The housing includes a plurality of piston chambers, a rotating shaft chamber, a high-pressure oil passage, and a low-pressure oil passage. Each of the plurality of piston assemblies is slidable up and down in a corresponding piston chamber of the plurality of piston chambers. The main shaft is rotatably connected to the housing and is connected to the plurality of piston assemblies in a transmission way.

11 Claims, 21 Drawing Sheets

RADIAL PISTON HYDRAULIC DEVICE DISTRIBUTED BY PILOT OPERATED CHECK VALVES

TECHNICAL FIELD

The present disclosure relates to a radial piston hydraulic device distributed by pilot operated check valves.

BACKGROUND

Radial piston hydraulic devices such as hydraulic motors or hydraulic pumps, having characteristics of low speed and high torque, are widely used in injection molding machines, construction machinery and other fields. The radial piston hydraulic pump is a kind of hydraulic power units configured to provide oil with a certain pressure to a hydraulic system. The radial piston hydraulic motor is a kind of commonly used hydraulic actuator, which is configured to drive a working mechanism to rotate at a certain speed. An output power of the hydraulic pump or the hydraulic motor depends on its working pressure and flow. The higher the working pressure, the greater the output power and the greater the load it can drive.

A distribution methods adopted by some radial piston hydraulic devices mainly comprises shaft distribution, valve plate distribution and check valve distribution. Among them, the hydraulic devices using shaft distribution and end distribution can work in a pump state and a motor state respectively. That is, when torque is input from a transmission shaft, the hydraulic device works in the pump state and pumps out high-pressure fluid. When the high-pressure fluid is input to the hydraulic device, the hydraulic device works in the motor state, and the torque is output from the transmission shaft. However, due to there are gaps in the above two distribution structures, and with the wear of moving pairs, the gaps gradually increase, so increase of its working pressure is limited. The distribution by the check valve has good sealing performance and the check valve can be used for the radial piston hydraulic pump to achieve high pressure and ultra-high pressure. However, an ordinary check valves only allows one-way flow and unable to be used for the radial piston hydraulic motor. Therefore, this kind of radial piston hydraulic device can only work in the pump state.

In summary, the conventional shaft distribution and valve plate distribution have become one of the key factors restricting increase of the working pressure of the radial piston hydraulic device such as the hydraulic motor and the hydraulic pump.

SUMMARY

The present disclosure provides a radial piston hydraulic device distributed by pilot operated check valves that overcomes defects mentioned in the prior art.

To solve the above technical problems, the present disclosure provides a radial piston hydraulic device distributed by pilot operated check valves.

The radial piston hydraulic device distributed by the pilot operated check valves comprises a housing, a plurality of piston assemblies, a main shaft, a rotating shaft, first pilot operated check valves having a same number with the plurality of piston assemblies and one-to-one corresponding to the plurality of piston assemblies, and second pilot operated check valves having a same number with the plurality of piston assemblies and one-to-one corresponding to the plurality of piston assemblies.

The housing comprises a plurality of piston chambers, a rotating shaft chamber, a high-pressure oil passage, and a low-pressure oil passage.

Each of the plurality of piston assemblies is slidable up and down in a corresponding piston chamber of the plurality of piston chambers.

The main shaft is rotatably connected to the housing and is connected to the plurality of piston assemblies in a transmission way.

The rotating shaft is rotatably mounted in the rotating shaft chamber and is fixedly connected to the main shaft. A control oil groove, a pressure relief oil groove, a first distribution ring groove, and a second distribution ring groove are provided on an outer periphery of the rotating shaft. The control oil groove is communicated with the high-pressure oil passage. The pressure relief oil groove is communicated with the low-pressure oil passage. The first distribution ring groove is divided into a first distribution upper half ring groove and a first distribution lower half ring groove. The second distribution ring groove is divided into a second distribution upper half ring groove and a second distribution lower half ring groove. The control oil groove is communicated with the first distribution upper half ring groove and the second distribution lower half ring groove. The pressure relief oil groove is communicated with the first distribution lower half ring groove and the second distribution upper half ring groove.

Each of the first pilot operated check valves comprises a first check valve body and a first check valve core. Each first check valve body comprises a first valve body oil control chamber, a first valve body high pressure chamber, and a first valve body low pressure chamber. Each first check valve core is movably mounted in a corresponding first check valve body and is configured to control on-off between a corresponding first valve body high pressure chamber and a corresponding first valve body low pressure chamber. Each first valve body low pressure chamber is communicated with a corresponding piston chamber of the plurality of piston chambers. Each first valve body high pressure chamber is communicated with the high-pressure oil passage. Each first valve body oil control chamber is alternately communicated with the first distribution upper half ring groove and the first distribution lower half ring groove.

Each of the second pilot operated check valves comprises a second check valve body and a second check valve core. Each second check valve body comprises a second valve body oil control chamber, a second valve body high pressure chamber, and a second valve body low pressure chamber. Each second check valve core is movably mounted in a corresponding second check valve body and is configured to control on-off between a corresponding second valve body high pressure chamber and a corresponding second valve body low pressure chamber. Each second valve body high pressure chamber is communicated with a corresponding piston chamber of the plurality of piston chambers. Each second valve body low pressure chamber is communicated with the low-pressure oil passage. Each second valve body oil control chamber is alternately communicated with the second distribution upper half ring groove and the second distribution lower half ring groove.

In one optional embodiment, the rotating shaft comprises two first connecting oil holes and two second connecting oil holes extending along an axial direction of the rotating shaft. A first one of the first connecting oil holes communicates the control oil groove with the first distribution upper half ring groove. A second one of the first connecting oil holes communicates the control oil groove with the second distribution lower half ring groove. A first one of the second connecting oil holes communicates the pressure relief oil groove with the first distribution lower half ring groove. A second one of the second connecting oil holes communicates the pressure relief oil groove with the second distribution upper half ring groove.

In one optional embodiment, the housing comprises a housing body and a valve plate. The main shaft is rotatably mounted the housing body and extends from a front end face of the housing body. The plurality of piston chambers are arranged on an outer periphery of the housing body. The valve plate is fixed to a rear end of the housing body. The rotating shaft chamber is defined in the valve plate and runs through the valve plate from front to rear.

In one optional embodiment, the housing body comprises a first high-pressure oil passage section and a first low-pressure oil passage section. The valve plate comprises a second high-pressure oil passage section communicated with the first high-pressure oil passage section and a second high-pressure oil passage section communicated with the first low-pressure oil passage section. The first high-pressure oil passage section and the second high-pressure oil passage section form the high-pressure oil passage. The first low-pressure oil passage section and the second low-pressure oil passage section form the low-pressure oil passage.

In one optional embodiment, a valve plate high pressure ring groove and a valve plate low pressure ring groove are provided on an outer periphery of the valve plate. A bottom wall of the valve plate high pressure ring groove defines a liquid resistance installation hole communicated with the control oil groove. A bottom wall of the valve plate low pressure ring groove defines a low pressure flow hole communicated with the pressure relief oil groove. The valve plate high pressure ring groove and the liquid resistance installation hole form the second high-pressure oil passage section. The valve plate low pressure ring groove and the low pressure flow hole form the second high-pressure oil passage section.

In one optional embodiment, the housing body comprises first oil control holes and first high pressure through holes. Each of the first oil control holes is communicated with a corresponding first valve body oil control chamber. Each of the first high pressure through holes communicates the valve plate high pressure ring groove with a corresponding first valve body high pressure chamber. The valve plate comprises second oil control holes communicated with the first oil control holes, the second oil control holes correspond to the first distribution ring groove. The housing body further comprises third oil control holes communicated with the second valve body oil control chamber and a first low pressure through holes communicated the valve plate low pressure ring groove with each second valve body low pressure chamber. The valve plate further comprises fourth oil control holes communicated with the third oil control holes. The fourth oil control holes correspond to the second distribution ring groove.

In one optional embodiment, each first check valve body comprises a first movable chamber. Each first check valve core comprises a first valve core column, a first valve core block fixed on a first end of the first valve core column, and a second valve core block fixed on a second end of the first valve core column. Each first valve core column is movably sleeved in a corresponding first movable chamber and drives a corresponding first valve core block and a corresponding second valve core block to move synchronously.

Each first valve core block is arranged in a corresponding first valve body oil control chamber and each first valve core block divides the corresponding first valve body oil control chamber into two first valve body oil control sub-chambers. Each second valve core block is arranged in a corresponding first valve body high pressure chamber and is movable between an open position and a close position of the corresponding first valve body high pressure chamber. Each first check valve core further comprises a first valve core elastic piece. Each first valve core elastic piece is sandwiched between a corresponding first valve core block and a chamber wall of a corresponding first valve body oil control chamber.

Each second check valve body comprises a second movable chamber. Each second check valve core comprises a second valve core column, a third valve core block fixed on a first end of the second valve core column, and a fourth valve core block fixed on a second end of the second valve core column. Each second valve core column is movably sleeved in a corresponding second movable chamber and drives a corresponding third valve core block and a corresponding fourth valve core block to move synchronously.

Each third valve core block is arranged in a corresponding second valve body oil control chamber and each third valve core block divides the corresponding second valve body oil control chamber into two second valve body oil control sub-chambers. Each fourth valve core block is arranged in a corresponding second valve body high pressure chamber and is movable between an open position and a close position of the corresponding second valve body high pressure chamber. Each second check valve core further comprises a second valve core elastic piece. Each second valve core elastic piece is sandwiched between a corresponding third valve core block and a chamber wall of a corresponding second valve body oil control chamber.

In one optional embodiment, the main shaft comprises a first main shaft section, a second main shaft section, a third main shaft section, and a fourth main shaft section. The first main shaft section, the second main shaft section, the third main shaft section, and the fourth main shaft section are connected in sequence. The first main shaft section is connected to the rotating shaft and drives the rotating shaft to rotate synchronously. The second main shaft section is eccentric. A double-row cylindrical roller bearing is arranged on an outer periphery of the second main shaft section. An outer ring of the double-row cylindrical roller bearing is connected to the plurality of piston assemblies. A third main shaft section bearing is arranged on an outer periphery of the third main shaft section. The fourth main shaft section extends out of the housing body.

In one optional embodiment, each of the piston assemblies comprises a piston, a piston slipper, and a piston return ring. Each piston is up and down slidably connected in a corresponding piston chamber. A top end of each piston slipper is sleeved in a corresponding piston. A bottom end of each piston slipper abuts against the outer ring of the double-row cylindrical roller bearing. Each piston return ring is sleeved on the bottom end of a corresponding piston slipper. Each piston slides up and down in the corresponding piston chamber through a corresponding piston slipper and a corresponding piston return ring to drive the main shaft to rotate. Or, the main shaft rotates to drive each piston to slide up and down in the corresponding piston chamber through the corresponding piston slipper and the corresponding piston return ring.

The present disclosure provides a wording method of the radial piston hydraulic device distributed by the pilot operated check valves that is applied to the radial piston hydraulic device distributed by pilot operated check valves mentioned above. When the radial piston hydraulic device distributed by pilot operated check valves is a hydraulic motor, the high-pressure oil passage is connected to a pressure oil source. The high-pressure oil passage is an oil inlet channel, and the low-pressure oil passage is an oil outlet channel.

When one of the plurality of piston assemblies is in am uppermost position of the plurality of piston assemblies, a corresponding first valve body oil control chamber is communicated with the first distribution upper half ring groove, a second valve body oil control chamber corresponding to the one of the plurality of piston assemblies is communicated with the second distribution upper half ring groove. A first check valve core corresponding to the one of the plurality of piston assemblies controls a corresponding first valve body high pressure chamber to communicate with a corresponding first valve body low pressure chamber. A second check valve core corresponding to the one of the plurality of piston assemblies controls a corresponding second valve body high pressure chamber to be disconnected from a corresponding second valve body low pressure chamber. Oil with high pressure flows through the high-pressure oil passage, the corresponding first valve body high pressure chamber, and the first valve body low pressure chamber, and then enters a corresponding piston chamber, so a piston corresponding to the one of the plurality of piston assemblies is pushed to move downward, a volume of a corresponding piston chamber increases. The corresponding piston chamber drives the main shaft to perform positive circular motion until the one of the plurality of piston assemblies reaches a lowermost position of the plurality of piston assemblies.

When the one of the plurality of piston assemblies is in the lowermost position of the plurality of piston assemblies, the main shaft and the rotating shaft forward rotate 180 degrees, the corresponding first valve body oil control chamber is communicated with the first distribution lower half ring groove, the second valve body oil control chamber corresponding to the one of the plurality of piston assemblies is communicated with the second distribution lower half ring groove. The first check valve core corresponding to the one of the plurality of piston assemblies controls the corresponding first valve body high pressure chamber to be disconnected from the corresponding first valve body low pressure chamber. The second check valve core corresponding to the one of the plurality of piston assemblies controls the corresponding second valve body high pressure chamber to communicate with the corresponding second valve body low pressure chamber. Under thrust of other piston assemblies of the plurality of piston assemblies and under inertial force of the main shaft, the one of the plurality of piston assemblies moves upward, the volume of the corresponding piston chamber decreases. Oil in the corresponding piston chamber passes through the corresponding second valve body high pressure chamber and the second valve body low pressure chamber and flows out from the low-pressure oil passage to realize a periodic movement of the one of the plurality of piston assemblies.

Periodic movement of the plurality of piston assemblies makes the main shaft to forward rotate. The radial piston hydraulic device distributed by the pilot operated check valves is configured to convert hydraulic energy into mechanical energy.

The present disclosure further provides a wording method of the radial piston hydraulic device distributed by pilot operated check valves that is applied to the radial piston hydraulic device distributed by the pilot operated check valves mentioned above. When the radial piston hydraulic device distributed by pilot operated check valves is a hydraulic pump, the high-pressure oil passage is connected to a high pressure oil tank or a hydraulic load and the high-pressure oil passage is configured as an oil outlet channel. The low-pressure oil passage is connected to a low pressure oil tank and the low-pressure oil passage is configured as an oil inlet channel.

The main shaft reversely rotates to drive one of the plurality of piston assemblies to move downward from an uppermost position of the plurality of piston assemblies, and a volume of a corresponding piston chamber increases to form a vacuum space, and a pressure in the corresponding piston chamber is lower than a pressure of the low pressure oil tank. A second valve body oil control chamber corresponding to the one of the plurality of piston assemblies is communicated with the second distribution lower half ring groove. A second check valve core corresponding to the one of the plurality of piston assemblies controls a corresponding second valve body high pressure chamber to communicate with a corresponding second valve body low pressure chamber. The first valve body oil control chamber corresponding to the one of the plurality of piston assemblies is communicated with the first distribution lower half ring. A first check valve core corresponding to the one of the plurality of piston assemblies controls a corresponding first valve body high pressure chamber to be disconnected from a corresponding first valve body low pressure chamber. Oil in the low pressure oil tank flows through the low-pressure oil passage, the corresponding second valve body low pressure chamber, and the corresponding second valve body high pressure chamber and enters the one of the plurality of piston assemblies until the one of the plurality of piston assemblies moves to a lowermost position of the plurality of piston assemblies. During a process where the one of the plurality of piston assemblies is moved from the uppermost position to the lowermost position of the plurality of piston assemblies, the main shaft drives the rotating shaft to reversely rotate 180 degrees.

The main shaft continues to reversely rotates 180 degrees. The one of the plurality of piston assemblies moves upward and the volume of the corresponding piston chamber decreases and the pressure in the corresponding piston chamber increase. The pressure in the corresponding piston chamber is greater than a pressure of the high pressure oil tank or a pressure of the hydraulic load. A first valve body oil control chamber corresponding to the one of the plurality of piston assemblies is communicated with the first distribution upper half ring groove. The first check valve core corresponding to the one of the plurality of piston assemblies controls a corresponding first valve body high pressure chamber to communicate with a corresponding first valve body low pressure chamber. The second valve body oil control chamber corresponding to the one of the plurality of piston assemblies is communicated with the second distribution upper half ring. The second check valve core corresponding to the one of the plurality of piston assemblies controls a corresponding second valve body high pressure chamber to be disconnected from a corresponding second valve body low pressure chamber. The oil in the corresponding piston chamber flows through the corresponding first valve body low pressure chamber and the corresponding first valve body high pressure chamber, and enters the high pressure oil tank or the hydraulic load to discharge the oil in the corresponding piston chamber.

The main shaft reversely rotates to drive the plurality of piston assemblies to move. The plurality of piston chambers suck up the oil with low pressure and discharge the oil with high pressure. The radial piston hydraulic device distributed by the pilot operated check valves is configured to convert mechanical energy into hydraulic energy.

Compared with the prior art, the radial piston hydraulic device distributed by the pilot operated check valves of the present disclosure has compact structure and simple transmission, and is capable of working stably under high pressure conditions. Further, the leakage is prevented. At the same time, the radial piston hydraulic device distributed by the pilot operated check valves is no need to be controlled by an external hydraulic source, so oil connection is simple.

Further, an oil distribution pressure of the rotating shaft is adjustable, and the oil distribution pressure is adjusted by liquid resistance.

Support is reliable and an operation is stable. The main shaft and the rotating shaft are reliably supported and are not easily deformed, so that the main shaft and the rotating shaft rotate smoothly.

A distribution pair has less friction, is stable in operation and has long service life.

BRIEF DESCRIPTION OF DRAWINGS

The present invention will be further described below with reference to the accompanying drawings and embodiments.

FIG. 8-1 is a top schematic diagram of a housing body.

FIG. 8-2 is a side schematic diagram of the housing body.

FIG. 8-3 is a cross-sectional schematic diagram of taken along the line C-C in FIG. 8-1

FIG. 8-4 is a cross-sectional schematic diagram of taken along the line D-Din FIG. 8-1.

FIG. 9-1 is a top schematic diagram of a first housing end cover.

FIG. 9-2 is a side schematic diagram of the first housing end cover.

FIG. 9-3 is a bottom schematic diagram of the first housing end cover.

FIG. 9-4 is a cross-sectional schematic diagram of the first housing end cover.

FIG. 10-1 is a top schematic diagram of a shaft end cover.

FIG. 10-2 is a side schematic diagram of the shaft end cover.

FIG. 10-3 is a bottom schematic diagram of the shaft end cover.

FIG. 10-4 is a cross-sectional schematic diagram of the shaft end cover.

FIG. 11-1 is a cross-sectional schematic diagram of a valve plate according to one embodiment of the preset disclosure.

FIG. 11-2 is a schematic diagram of the valve plate according to one embodiment of the preset disclosure.

FIG. 11-3 is another cross-sectional schematic diagram of the valve plate according to one embodiment of the preset disclosure.

FIG. 11-4 is a side schematic diagram of the valve plate according to tone embodiment of the preset disclosure.

FIG. 11-5 is another cross-sectional schematic diagram of the valve plate according to one embodiment of the preset disclosure.

FIG. 12-1 is a top schematic diagram of a second housing end cover.

FIG. 12-2 is a side schematic diagram of the second housing end cover.

FIG. 12-3 is a bottom schematic diagram of the second housing end cover.

FIG. 12-4 is a cross-sectional schematic diagram of the second housing end cover.

FIG. 13-1 is a top schematic diagram of a piston cover.

FIG. 13-2 is a side schematic diagram of the piston cover.

FIG. 13-3 is a cross-sectional schematic diagram of the piston cover.

FIG. 14-1 is a side schematic diagram of a main shaft.

FIG. 14-2 is a left side schematic diagram of the main shaft.

FIG. 14-3 is a schematic diagram of a right end of the main shaft.

FIG. 14-4 is a cross-sectional schematic diagram of the main shaft.

FIG. 15-1 is a side schematic diagram of a rotating shaft.

FIG. 15-2 is a cross-sectional schematic diagram of the rotating shaft.

FIG. 15-3 is a cross-sectional schematic diagram of taken along the line G-G in FIG. 15-2.

FIG. 15-4 is a cross-sectional schematic diagram of taken along the line H-H in FIG. 15-2.

FIG. 15-5 is a cross-sectional schematic diagram of taken along the line I-I in FIG. 15-2.

FIG. 15-6 is a cross-sectional schematic diagram of taken along the line J-J in FIG. 15-2.

FIG. 16-1 is a side schematic diagram of a main shaft sleeve.

FIG. 16-2 is a cross-sectional schematic diagram of the main shaft sleeve.

FIG. 17-1 is a cross-sectional schematic diagram of a first pilot operated check valve.

FIG. 17-2 is a schematic diagram of a right end of the first pilot operated check valve.

FIG. 17-3 is a side schematic diagram of the first pilot operated check valve.

DETAILED DESCRIPTION

Figure 1:
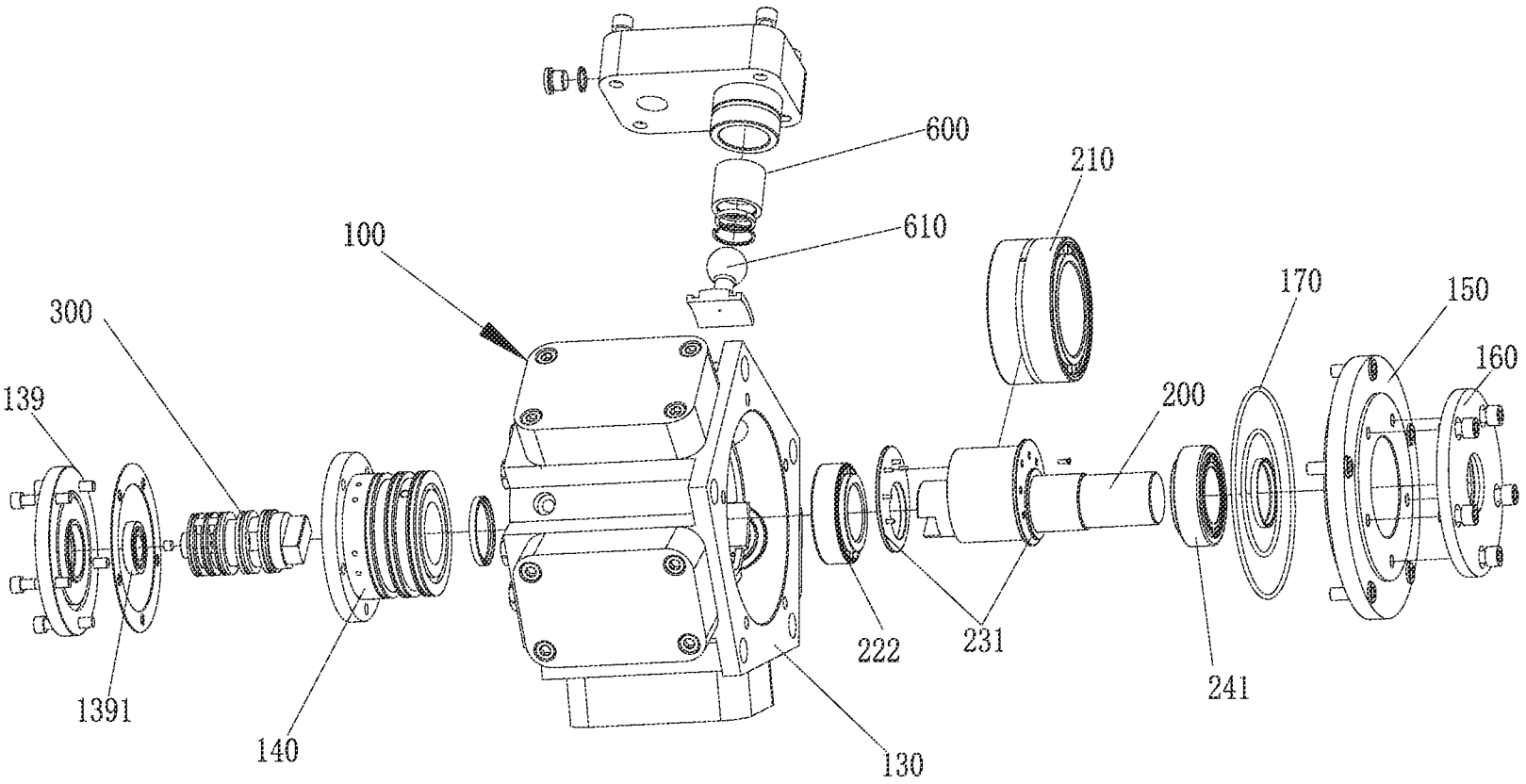
FIG. 1 is an exploded schematic diagram of a radial piston hydraulic device distributed by pilot operated check valves according to one optional embodiment of the present disclosure.

In the claims, specification and the above-mentioned drawings of the present disclosure, unless otherwise expressly defined, for orientation terms such as "first", "second", "third", etc., are used to distinguish different objects, instead of describing a specific order.

It should be understood that in the claims, specification and the above-mentioned drawings of the present disclosure, unless otherwise expressly defined, for orientation terms such as "central", "lateral", "lengthways", "length", "width", "thickness", "upper", "lower", "left", "right", "vertical", "horizontal", "top", "bottom", "inner", "outer", "forward", "reversely", etc. indicate direction or position relationships shown based on the drawings, and are only intended to facilitate the description of the present disclosure and the simplification of the description rather than to indicate or imply that the indicated device or element must have a specific direction or constructed and operated in a specific direction, and therefore, shall not be understood as a limitation to the present disclosure.

In the claims, specification and the above-mentioned drawings of the present disclosure, unless otherwise expressly defined, the terms "fixed connection" and "fixed connected" should be understood in a broad sense. That is, fixed connection refers to any connection method that has no displacement relationship and relative rotation relationship between two components, which includes non-removable fixed connection, detachable fixed connection, integrated and fixed connection by other means or elements.

In the claims, specification and the above-mentioned drawings of the present disclosure, terms "comprise", "include", and variations thereof mean "including but not limited to".

As shown in FIGS. 1-17, in one optional embodiment, the present disclosure provides a radial piston hydraulic device distributed by pilot operated check valvest.

The radial piston hydraulic device distributed by the pilot operated check valves comprises a housing 100, a plurality of piston assemblies, a main shaft 200, the rotating shaft 300, first pilot operated check valves 400 having a same number with the plurality of piston assemblies and one-to-one corresponding to the plurality of piston assemblies, and second pilot operated check valves 500 having a same number with the plurality of piston assemblies and one-to-one corresponding to the plurality of piston assemblies.

The housing 100 comprises a plurality of piston chambers 110, a rotating shaft chamber 120, a high-pressure oil passage, and a low-pressure oil passage.

Figure 3:
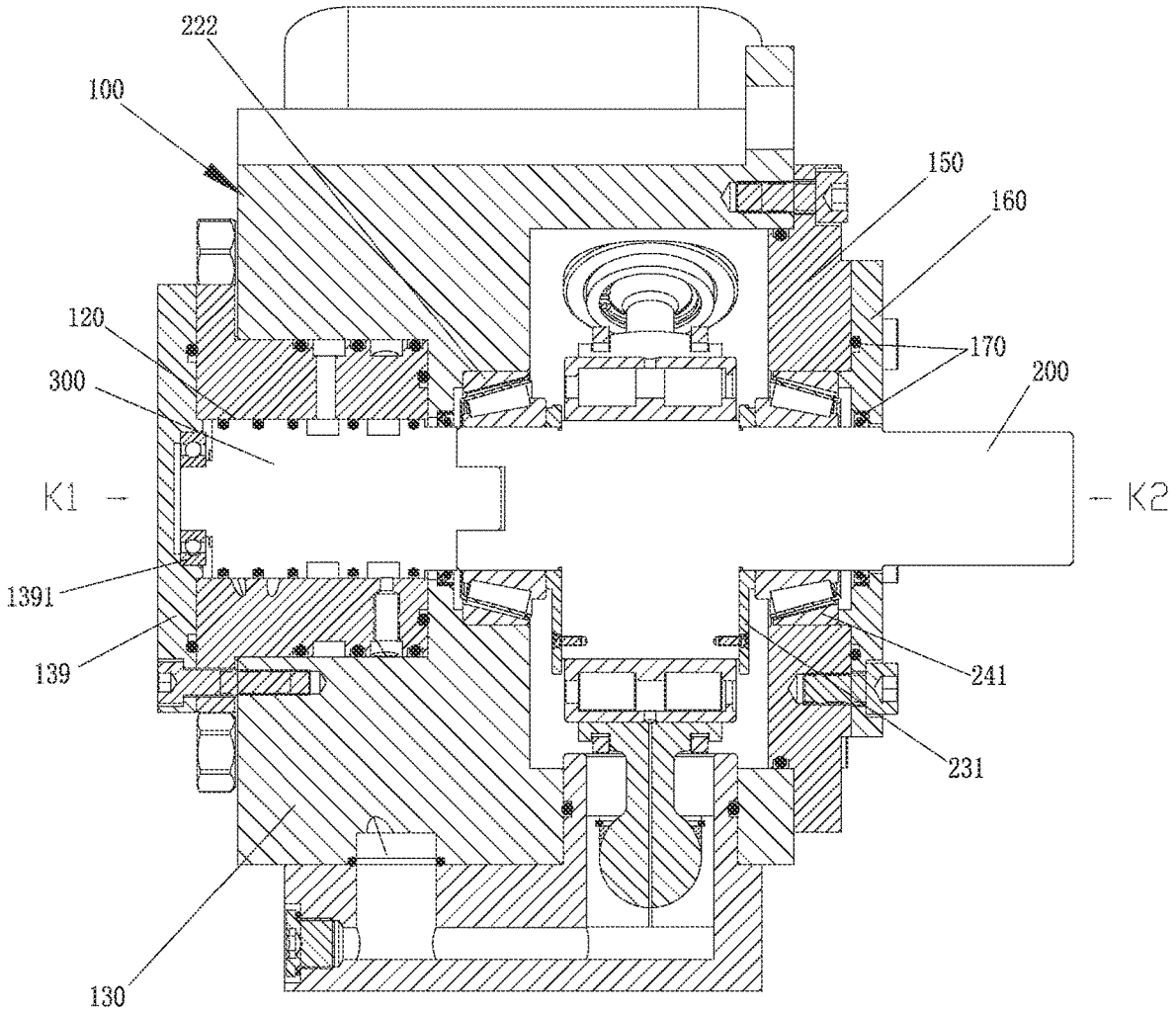
FIG. 3 is a vertical cross-sectional schematic diagram of the radial piston hydraulic device.

In one optional embodiment, the housing 100 comprises a housing body 130 and a valve plate 140. The plurality of piston chambers 110 are arranged on an outer periphery of the housing body 130. The rotating shaft chamber 120 is defined in the valve plate 140 and runs through the valve plate 140 from front to rear. As shown in FIG. 3, a central axis of the housing 100 is defined as K1K2. One end of the housing close to K1 is the rear end of the housing 100, and another end of the housing close to K2 is a front end of the casing 100.

Figure 2:
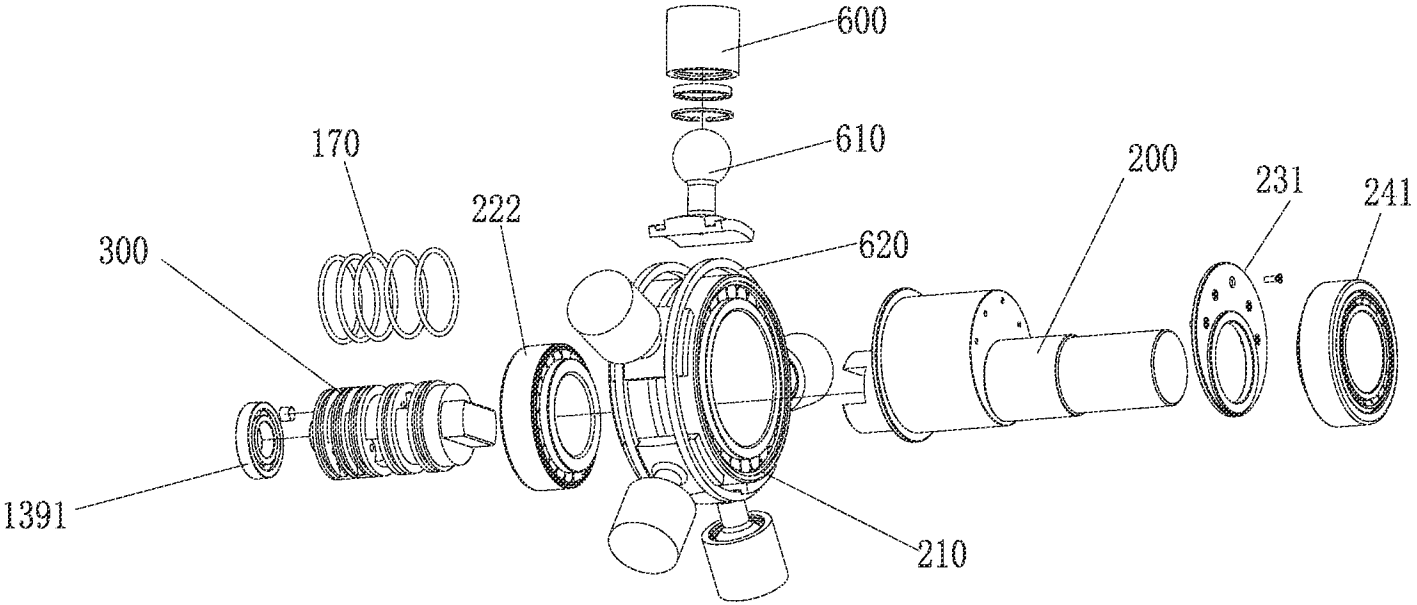
FIG. 2 is an assemble schematic diagram of a main shaft, a rotating shaft, and a plurality of piston assemblies.
Figures 1, 8:
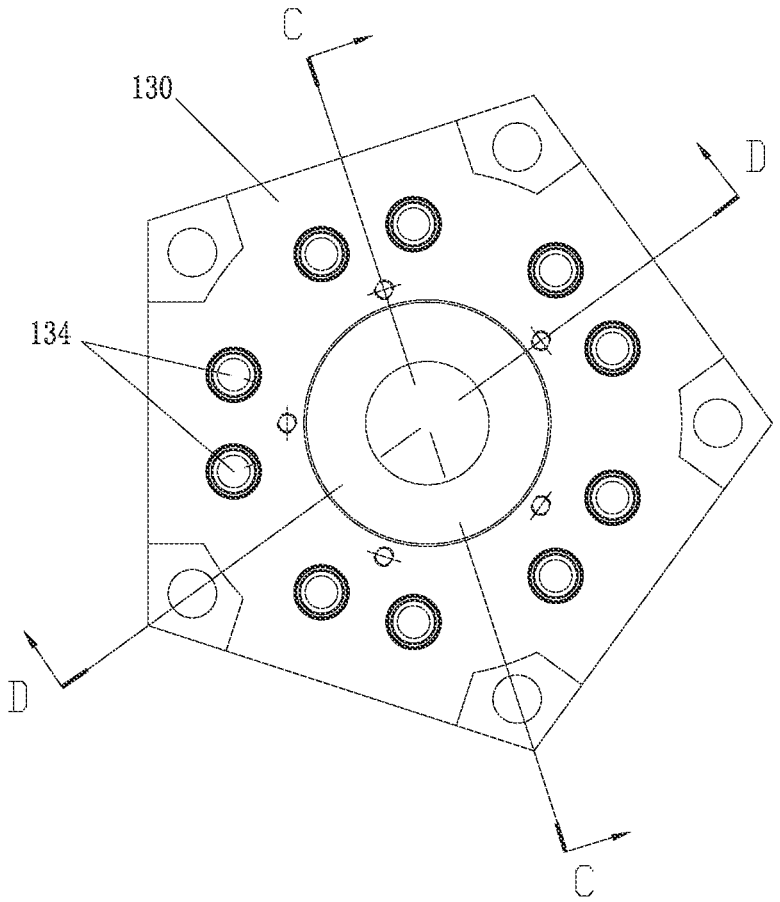
Figures 2, 8:
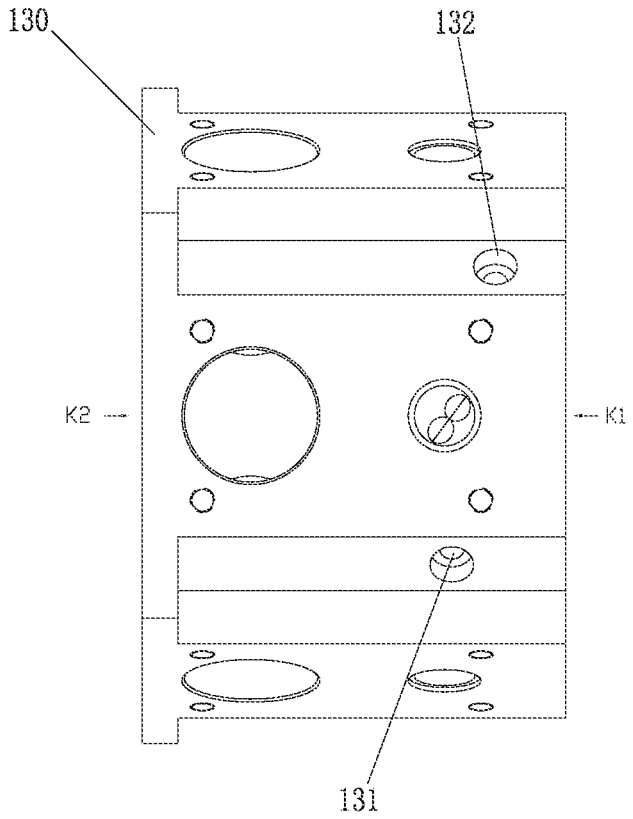
Figures 3, 8:
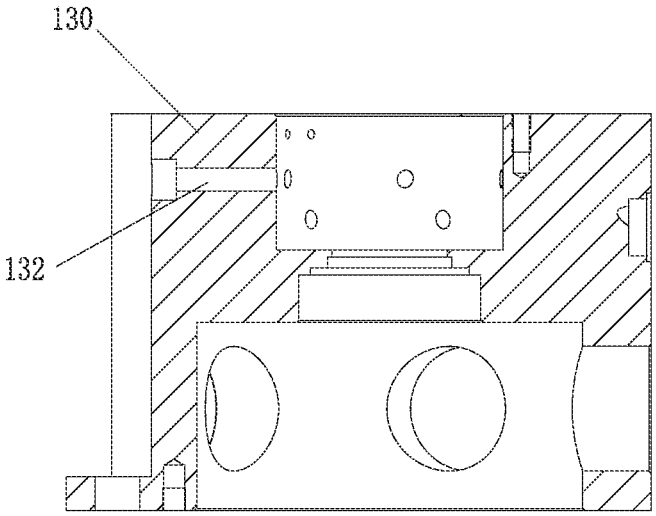
Figures 4, 8:
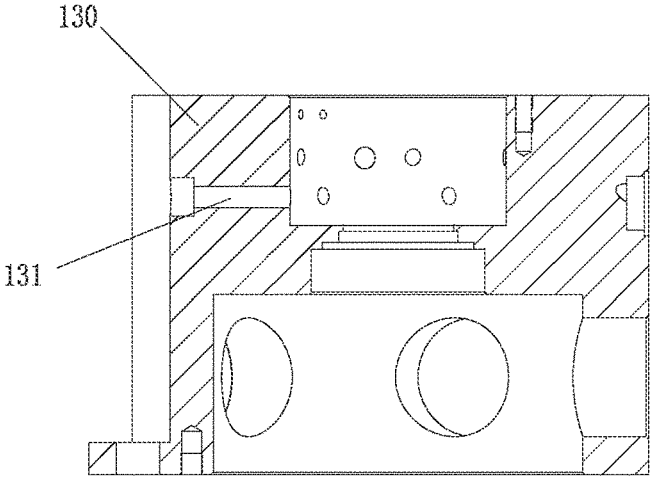
Figures 1, 9:
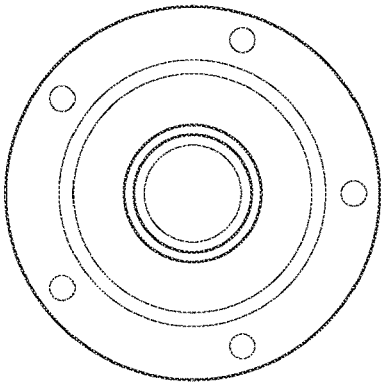
Figures 2, 9:
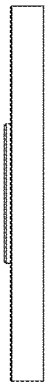
Figures 3, 9:
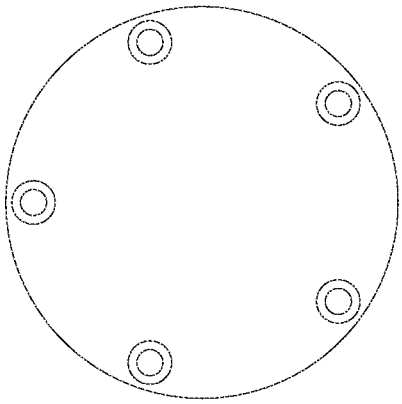
Figures 4, 9:
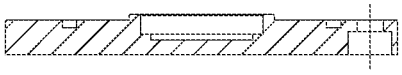
Figures 1, 10:
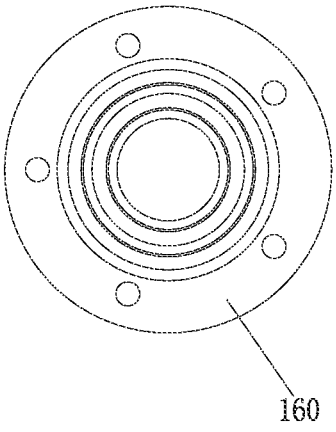
Figures 2, 10:
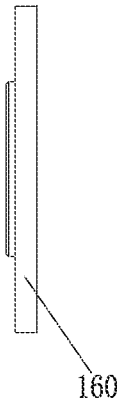
Figures 3, 10:
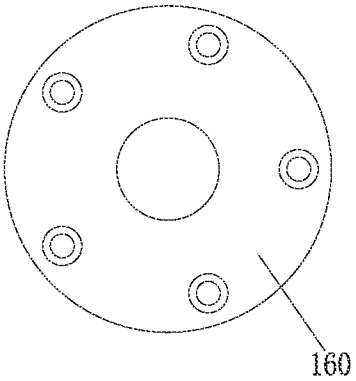
Figures 4, 10:
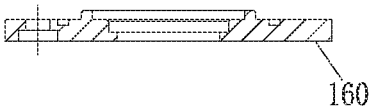

In the embodiment, the housing body 130 comprises a first high-pressure oil passage section 131 and a first low-pressure oil passage section 132. The valve plate 140 comprises a second high-pressure oil passage section communicated with the first high-pressure oil passage section 131 and a second high-pressure oil passage section communicated with the first low-pressure oil passage section 132. The first high-pressure oil passage section 131 and the second high-pressure oil passage section form the high-pressure oil passage. The first low-pressure oil passage section 132 and the second low-pressure oil passage section form the low-pressure oil passage. As shown in FIG. 8-2, the first high-pressure oil passage section 131 and the first low-pressure oil passage section 132 extend to one side of the housing body.

Figures 1, 11:
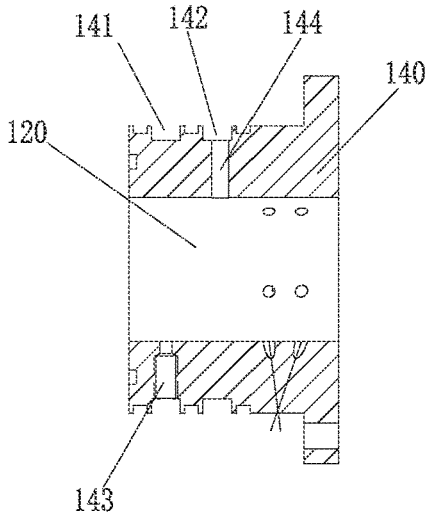
Figures 2, 11:
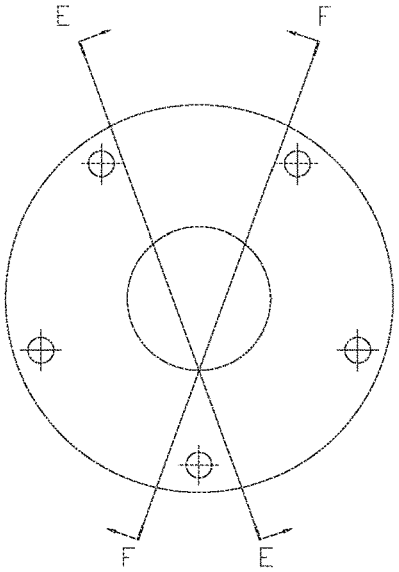
Figures 3, 11:
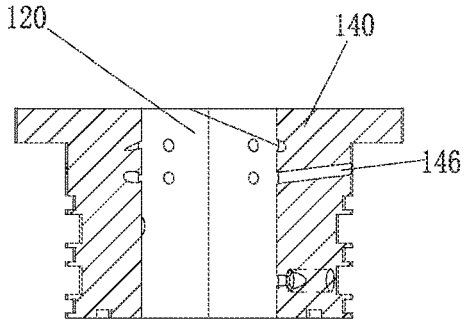
Figures 4, 11:
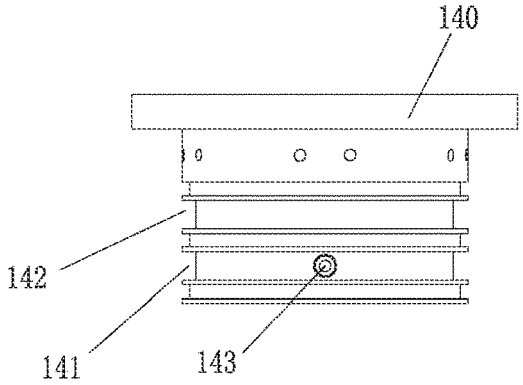
Figures 5, 11:
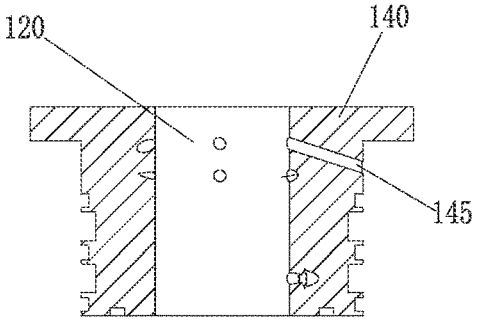
Figures 1, 12:
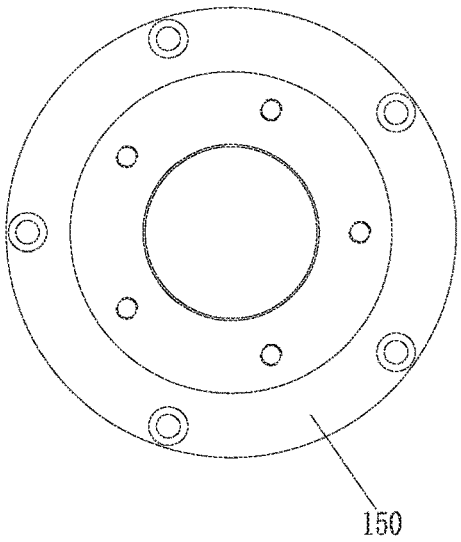
Figures 2, 12:
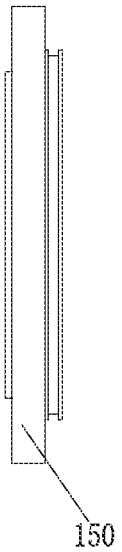
Figures 3, 12:
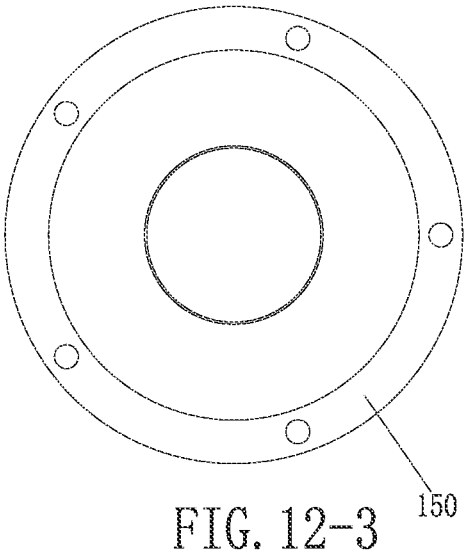
Figures 4, 12:
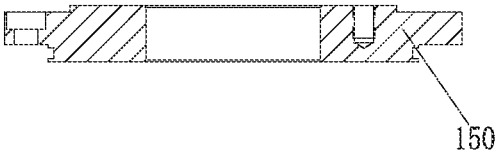
Figures 1, 13:
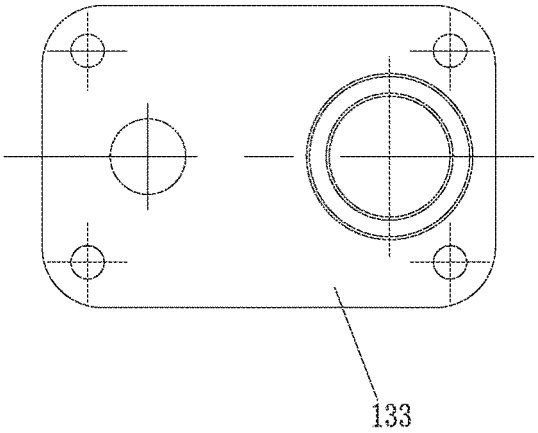
Figures 2, 13:
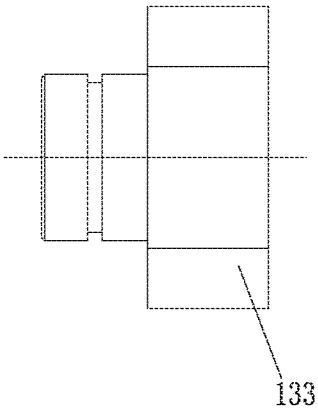
Figures 3, 13:
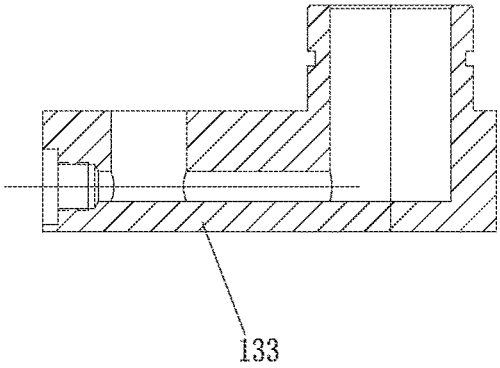
Figures 1, 14:
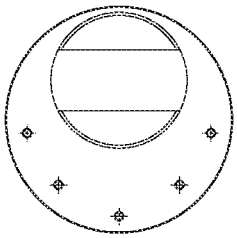
Figures 2, 14:
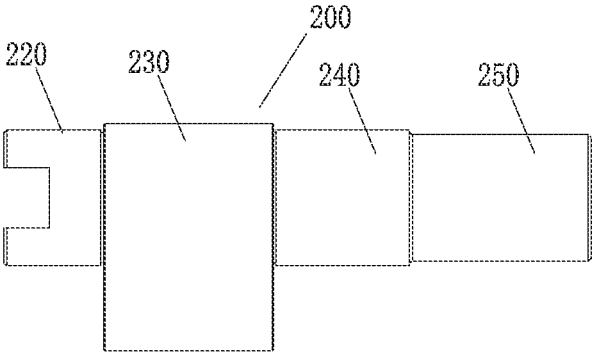
Figures 3, 14:
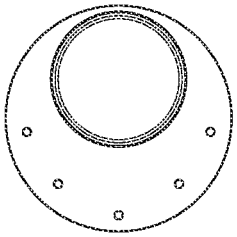
Figures 4, 14:
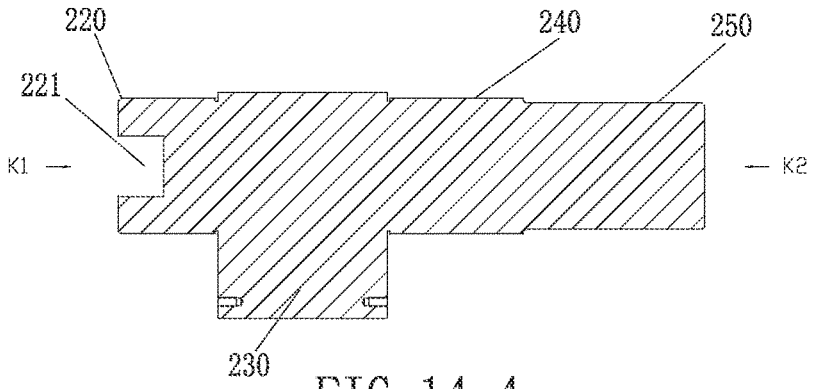

In the embodiment, a valve plate high pressure ring groove 141 and a valve plate low pressure ring groove 142 are provided on an outer periphery of the valve plate 140. A bottom wall of the valve plate high pressure ring groove 141 defines a liquid resistance installation hole 143 communicated with the control oil groove. A bottom wall of the valve plate low pressure ring groove 142 defines a low pressure flow hole 144 communicated with a pressure relief oil groove. As shown in FIG. 11-1, the valve plate high pressure ring groove 141 and the liquid resistance installation hole 143 form the second high-pressure oil passage section. The valve plate low pressure ring groove 142 and the low pressure flow hole 144 form the second high-pressure oil passage section.

Figure 4:
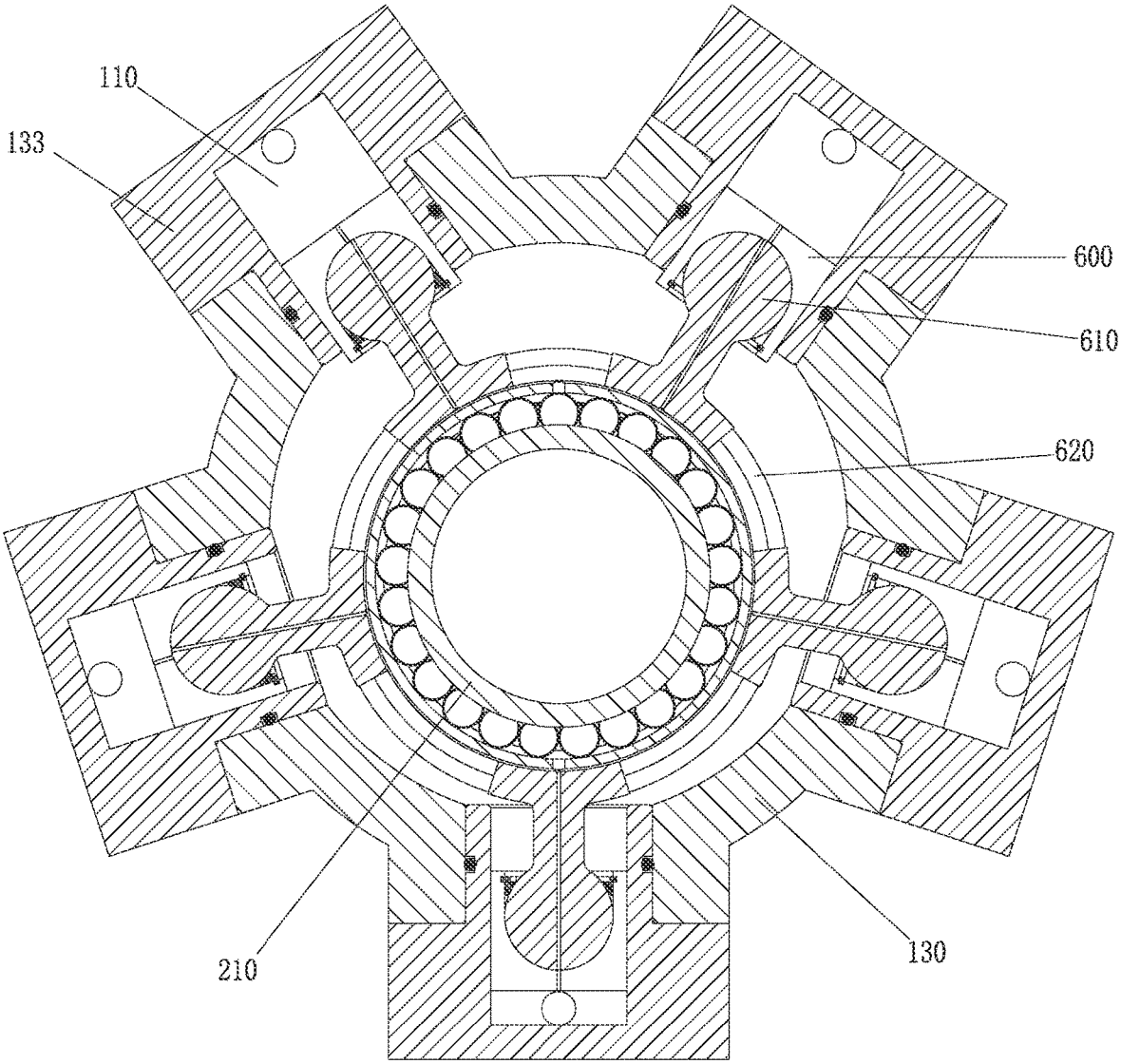
FIG. 4 is a horizontal cross-sectional schematic diagram of the radial piston hydraulic device.
Figure 5:
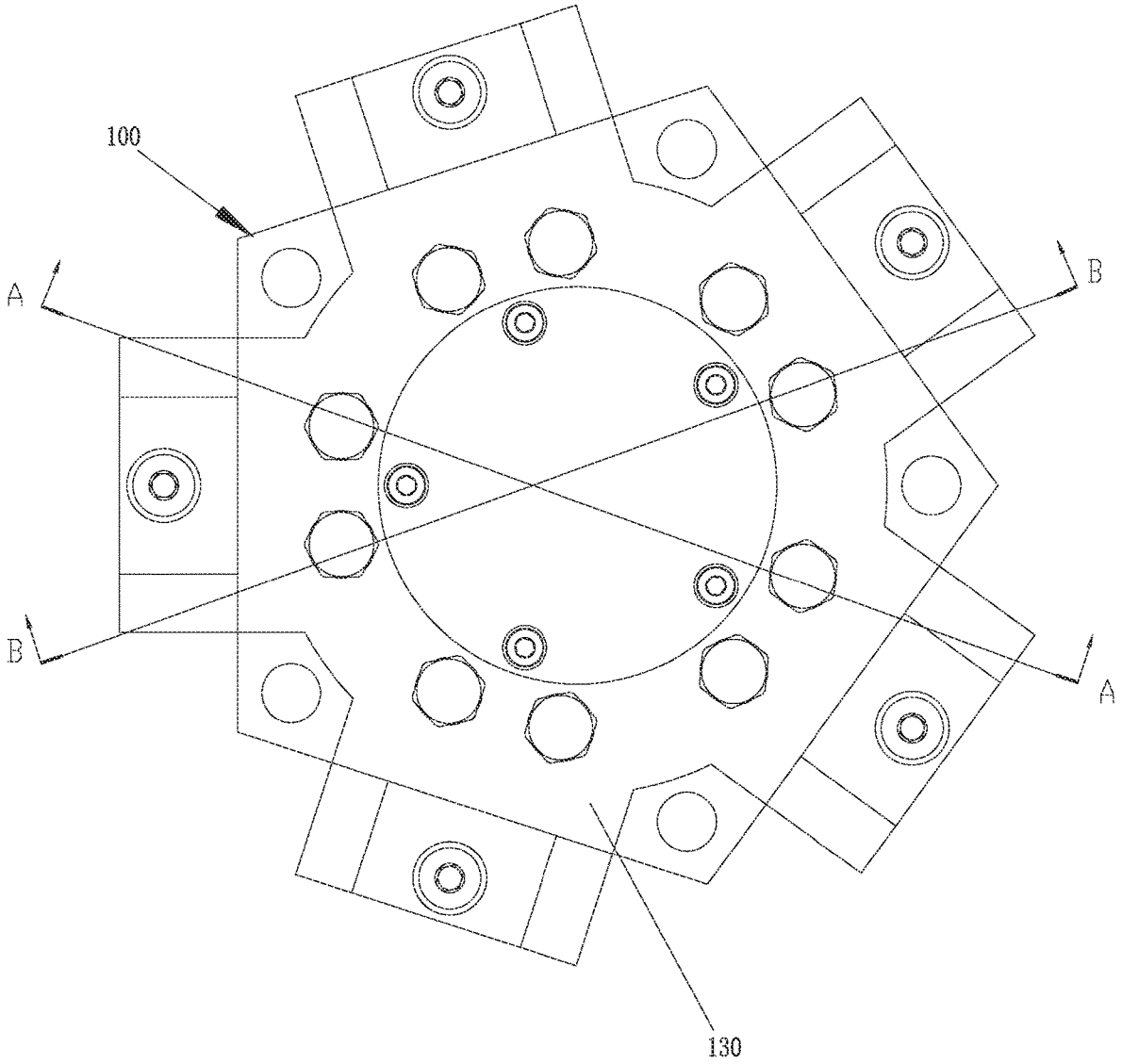
FIG. 5 is a top schematic diagram of the radial piston hydraulic device.

As shown in FIGS. 4 and 5, the housing body 130 is in the shape of a pentagon. Each edge of the pentagon is provided with a piston cover 133. Each piston cover 133 and a corresponding edge of the pentagon of the housing body 130 form one piston chamber 110. That is, there are five piston chambers 110, and therefore, there are five first pilot operated check valves 400 and five second pilot operated check valves 500. As shown in FIG. 8-1, five groups of pilot operated check valve holes 134 are defined on an end face of the housing body 130 close to K1, and each group of pilot operated check valve holes 134 comprises two pilot operated check valve holes 134. Each of the first pilot operated check valves 400 and each of the second pilot operated check valves 500 are separately installed in a corresponding group of two pilot operated check valve holes 134.

Each of the first pilot operated check valves 400 comprises a first check valve body 410 and a first check valve core 420. Each first check valve body 410 comprises a first valve body oil control chamber 411, a first valve body high pressure chamber 412, and a first valve body low pressure chamber 413. Each first check valve core 420 is movably mounted in a corresponding first check valve body 410 and is configured to control on-off between a corresponding first valve body high pressure chamber 412 and a corresponding first valve body low pressure chamber 413. Each first valve body low pressure chamber 413 is communicated with a corresponding piston chamber 110 of the plurality of piston chambers. Each first valve body high pressure chamber 412 is communicated with the high-pressure oil passage. Each first valve body oil control chamber 411 is alternately communicated with the first distribution upper half ring groove 340 and the first distribution lower half ring groove 350.

In the embodiment, each first check valve body 410 comprises a first movable chamber 414. Each first check valve core 420 comprises a first valve core column 421, a first valve core block 422 fixed on a first end of the first valve core column 421, and a second valve core block 423 fixed on a second end of the first valve core column 421. Each first valve core column 421 is movably sleeved in a corresponding first movable chamber 414 and drives a corresponding first valve core block 422 and a corresponding second valve core block 423 to move synchronously.

Each first valve core block 422 is arranged in a corresponding first valve body oil control chamber 411 and each first valve core block 422 divides the corresponding first valve body oil control chamber 411 into two first valve body oil control sub-chambers 4111, 4112. Each second valve core block 423 is arranged in a corresponding first valve body high pressure chamber 412 and is movable between an open position and a close position of the corresponding first valve body high pressure chamber 412. Each first check valve core further comprises a first valve core elastic piece 430. Each first valve core elastic piece 430 is sandwiched between a corresponding first valve core block 422 and a chamber wall of a corresponding first valve body oil control chamber 423.

Each of the second pilot operated check valves 500 comprises a second check valve body 510 and a second check valve core 520. Each second check valve body 510 comprises a second valve body oil control chamber, a second valve body high pressure chamber, and a second valve body low pressure chamber. Each second check valve core 520 is movably mounted in a corresponding second check valve body 510 and is configured to control on-off between a corresponding second valve body high pressure chamber and a corresponding second valve body low pressure chamber. Each second valve body high pressure chamber is communicated with a corresponding piston chamber of the plurality of piston chambers. Each second valve body low pressure chamber is communicated with the low-pressure oil passage. Each second valve body oil control chamber is alternately communicated with the second distribution upper half ring groove 360 and the second distribution lower half ring groove 370.

In the embodiment, each second check valve body comprises a second movable chamber. Each second check valve core comprises a second valve core column, a third valve core block fixed on a first end of the second valve core column, and a fourth valve core block fixed on a second end of the second valve core column. Each second valve core column is movably sleeved in a corresponding second movable chamber and drives a corresponding third valve core block and a corresponding fourth valve core block to move synchronously.

Each third valve core block is arranged in a corresponding second valve body oil control chamber and each third valve core block divides the corresponding second valve body oil control chamber into two second valve body oil control sub-chambers. Each fourth valve core block is arranged in a corresponding second valve body high pressure chamber and is movable between an open position and a close position of the corresponding second valve body high pressure chamber. Each second check valve core further comprises a second valve core elastic piece. Each second valve core elastic piece is sandwiched between a corresponding third valve core block and a chamber wall of a corresponding second valve body oil control chamber. In the embodiment, a structure of each of the first check valves is same as a structure of each of the second check valves.

Figure 6:
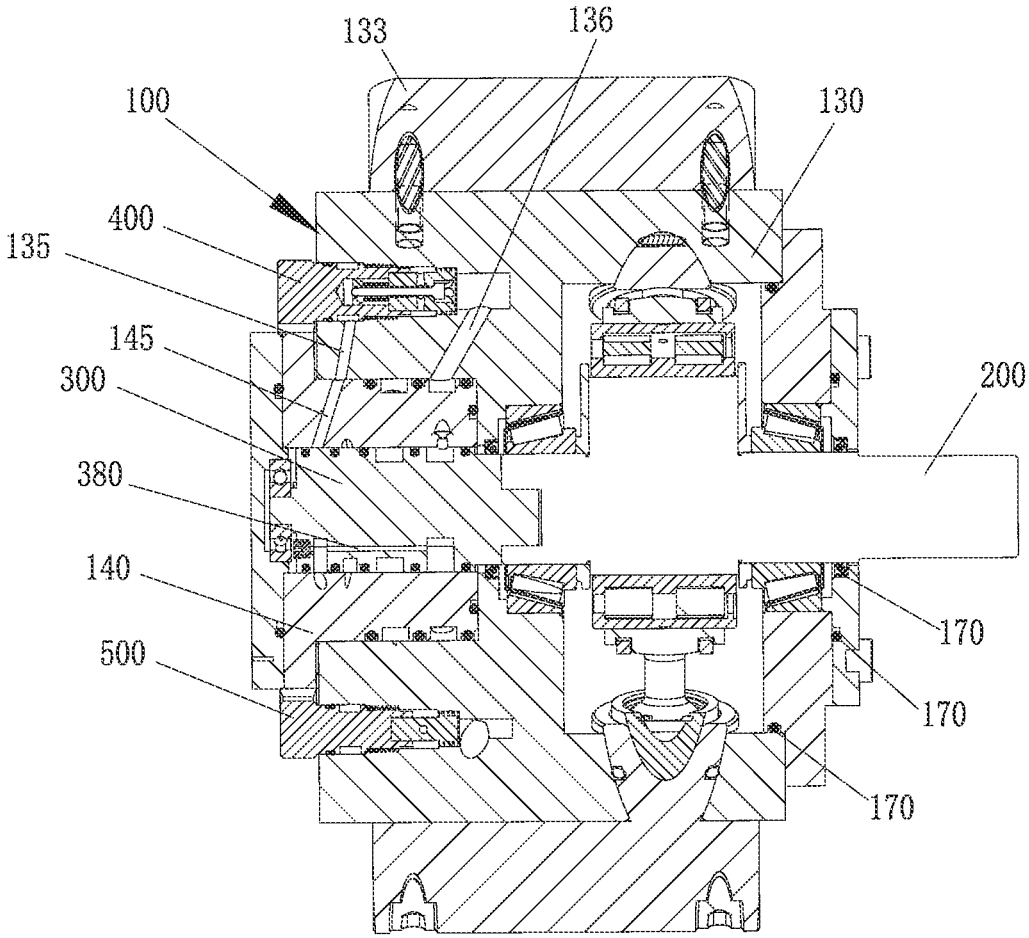
FIG. 6 is a cross-sectional schematic diagram of taken along the line A-A in FIG. 5.
Figure 7:
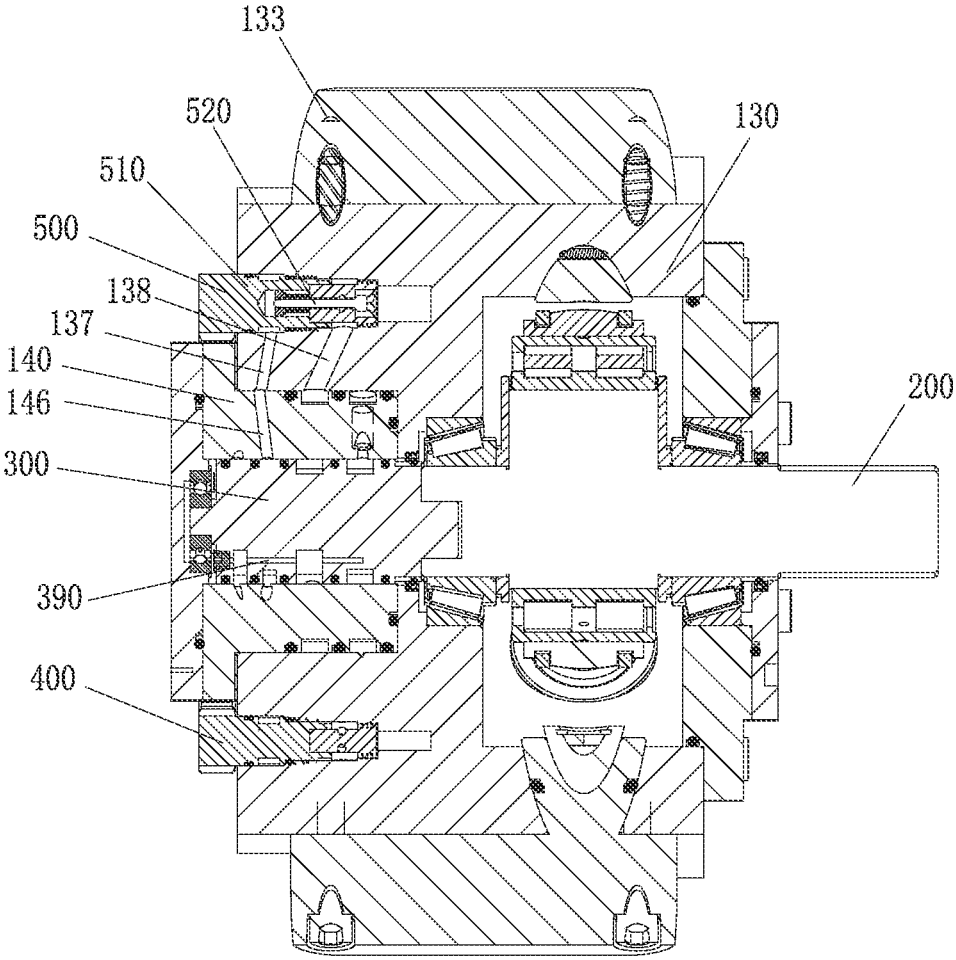
FIG. 7 is a cross-sectional schematic diagram of taken along the line B-B in FIG. 5.

In the optional embodiment, as shown in FIG. 6, the housing body 130 comprises first oil control holes 135 and first high pressure through holes 136. Each of the first oil control holes 135 is communicated with a corresponding first valve body oil control chamber 411. Each of the first high pressure through holes 136 communicates the valve plate high pressure ring groove 141 with a corresponding first valve body high pressure chamber 412. The valve plate 140 comprises second oil control holes 145 communicated with the first oil control holes. The second oil control holes 145 correspond to the first distribution ring groove of the rotating shaft 300. The housing body 130 further comprises third oil control holes 137 communicated with the second valve body oil control chamber and a first low pressure through holes 138 communicated the valve plate low pressure ring groove 142 with each second valve body low pressure chamber. The valve plate 140 further comprises fourth oil control holes 146 communicated with the third oil control holes 145. The fourth oil control holes 146 correspond to the second distribution ring groove of the rotating shaft 300.

Each of the plurality of piston assemblies is slidable up and down in a corresponding piston chamber 110 of the plurality of piston chambers.

In the embodiment, each of the piston assemblies comprises a piston 600, a piston slipper 610, and a piston return ring 620. Each piston 610 is up and down slidably connected in a corresponding piston chamber. 110 A top end of each piston slipper 610 is sleeved in a corresponding piston 600. A bottom end of each piston slipper 610 abuts against the outer ring of the double-row cylindrical roller bearing 210 arranged outside the main shaft 200. Each piston return ring 620 is sleeved on the bottom end of a corresponding piston slipper 610. Each piston 600 slides up and down in the corresponding piston chamber 110 through a corresponding piston slipper 610 and a corresponding piston return ring 620 to drive the main shaft 200 to rotate. Alternatively, the main shaft 200 rotates to drive each piston 600 to slide up and down in the corresponding piston chamber 110 through the corresponding piston slipper 610 and the corresponding piston return ring 620. The piston assemblies in the present disclosure have a same structure as conventional piston assemblies.

The main shaft 200 is rotatably connected to the housing 100 and is connected to the plurality of piston assemblies in a transmission way.

In the embodiment, the main shaft 200 is rotatably mounted the housing body 130 and extends from a front end face of the housing body 130.

In the optional embodiment, the main shaft 200 comprises a first main shaft section 220, a second main shaft section 230, a third main shaft section 240, and a fourth main shaft section 250. The first main shaft section, the second main shaft section, the third main shaft section, and the fourth main shaft section are connected in sequence. The first main shaft section 220 is connected to the rotating shaft 300 and drives the rotating shaft 300 to rotate synchronously. The second main shaft section 230 is eccentric. A double-row cylindrical roller bearing 210 is arranged on an outer periphery of the second main shaft section 230. An outer ring of the double-row cylindrical roller bearing is connected to the plurality of piston assemblies. A third main shaft section bearing 241 is arranged on an outer periphery of the third main shaft section 240. The fourth main shaft section 250 extends out of the housing body 130.

Figures 1, 16:
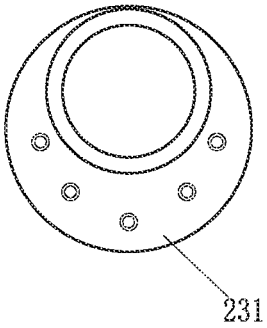
Figures 2, 16:
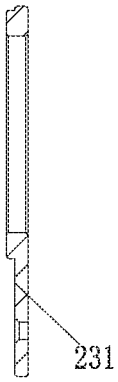
Figures 1, 17:
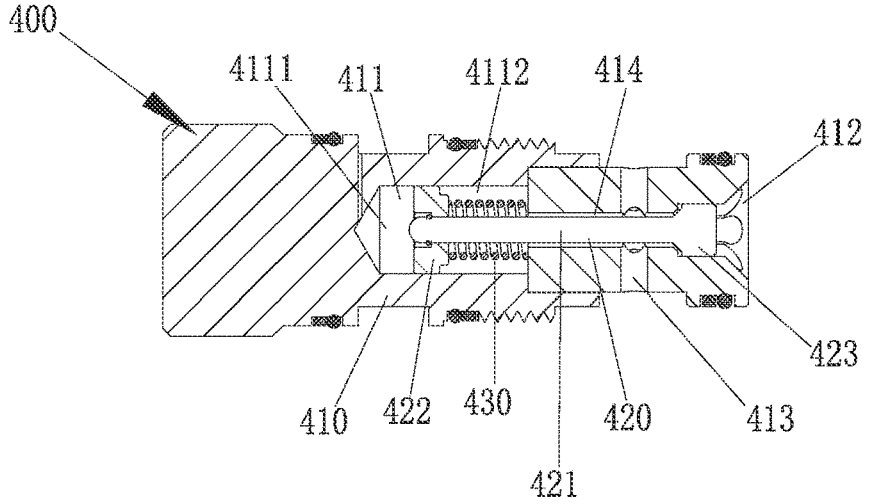
Figures 2, 17:
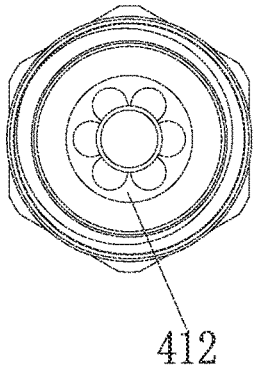
Figures 3, 17:
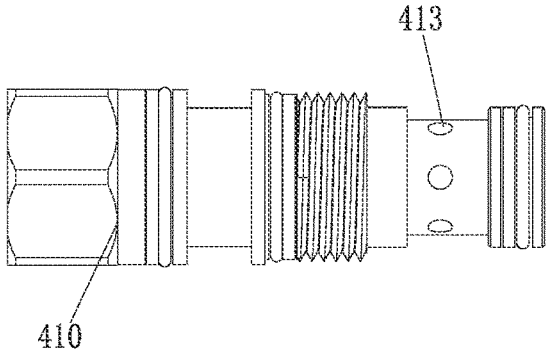

As shown in FIG. 2, the piston return ring is sleeved on the outer ring of the double-row cylindrical roller bearing. As shown in FIG. 1, main shaft sleeves 231 are separately sleeved on a front side and a rear side of the second main shaft section 230, and the specific structures of the main shaft sleeves 231 are shown in FIGS. 16-1 and 16-2. Furthermore, a first bearing 222 is arranged on an outer circumference of the first main shaft section 220. In the embodiment, the third main shaft section bearing 241 is defined as a second bearing 241. A second housing end cover 150 is locked on an end face of the housing body 130 close to the central axis K2 by bolts. An inner end face of the second housing end cover 150 is pressed against the second bearing 241. A shaft end cover 160 is locked on an outer end surface of the second housing end cover 150 through bolts. In order to ensure sealing, sealing rings are separately arranged between the second housing end cover 150 and the shaft end cover 160, between the second housing end cover 150 and the housing body 130, and between the third main shaft section 240 and the shaft end cover 160. The rotating shaft 300 is rotatably mounted in the rotating shaft chamber 120 and is fixedly connected to the main shaft 200. A control oil groove 320, a pressure relief oil groove 330, a first distribution ring groove, and a second distribution ring groove are provided on an outer periphery of the rotating shaft 300. The control oil groove 320 is communicated with the high-pressure oil passage. The pressure relief oil groove 330 is communicated with the low-pressure oil passage. The first distribution ring groove is divided into a first distribution upper half ring groove 340 and a first distribution lower half ring groove 350. The second distribution ring groove is divided into a second distribution upper half ring groove 360 and a second distribution lower half ring groove 370. The control oil groove 320 is communicated with the first distribution upper half ring groove 340 and the second distribution lower half ring groove 370. The pressure relief oil groove 330 is communicated with the first distribution lower half ring groove 350 and the second distribution upper half ring groove 360.

Figures 1, 15:
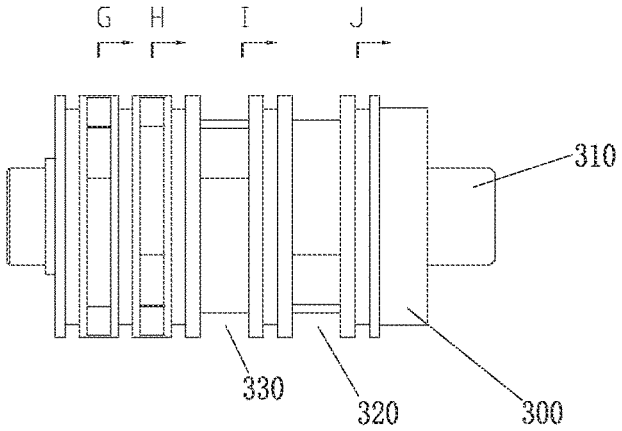
Figures 2, 15:
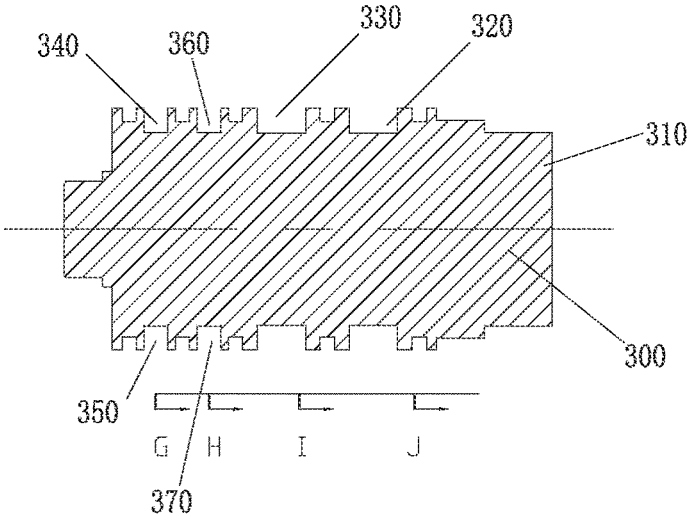
Figures 3, 15:
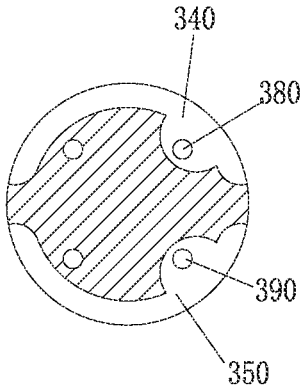
Figures 4, 15:
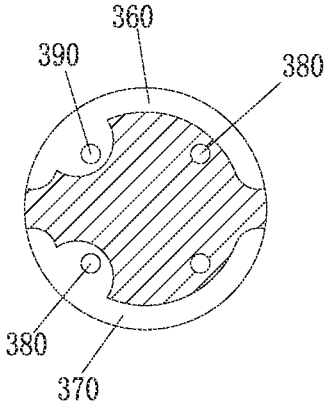
Figures 5, 15:
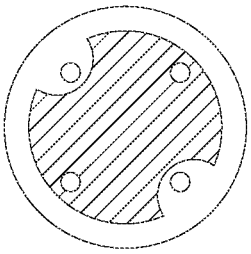
Figures 6, 15:
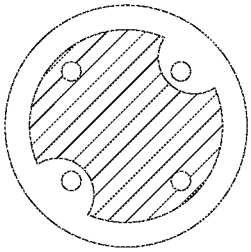

In the optional embodiment, as shown in FIG. 15-1 to FIG. 15-6, the rotating shaft 300 comprises two first connecting oil holes 380 and two second connecting oil holes 390 extending along an axial direction of the rotating shaft. A first one of the first connecting oil holes 380 communicates the control oil groove 320 with the first distribution upper half ring groove 370. A second one of the first connecting oil holes 380 communicates the control oil groove 320 with the second distribution lower half ring groove 370. A first one of the second connecting oil holes 390 communicates the pressure relief oil groove 330 with the first distribution lower half ring groove 350. A second one of the second connecting oil holes 390 communicates the pressure relief oil groove 330 with the second distribution upper half ring groove 360.

Further, as shown in FIG. 6, the end face of the housing body 130 close to the central axis K1 is locked with a first housing end cover 139 by the bolts. The first housing end cover 139 is pressed against the valve plate 140 and the rotating shaft 300, A deep groove ball bearing 1391 is arranged between the first housing end cover 139 and the rotating shaft 300. To ensure sufficient sealing, the sealing rings 170 are separately arranged between the rotating shaft 300 and the rotating shaft chamber 120, between the first housing end cover 139 and the valve plate 140, and between the valve plate 140 and the housing body 130.

In one optional embodiment, the present disclosure provides a wording method of the radial piston hydraulic device distributed by the pilot operated check valves that is applied to the radial piston hydraulic device distributed by the pilot operated check valves mentioned above.

When the radial piston hydraulic device distributed by the pilot operated check valves is a hydraulic motor, the high-pressure oil passage is connected to a pressure oil source. The high-pressure oil passage is an oil inlet channel, and the low-pressure oil passage is an oil outlet channel.

When one of the plurality of piston assemblies is in am uppermost position of the plurality of piston assemblies, a corresponding first valve body oil control chamber 411 is communicated with the first distribution upper half ring groove 340, oil with high pressure is flowed into the corresponding first valve body oil control chamber 411, making a corresponding first check valve core 420 controlling a corresponding first valve body high pressure chamber 412 to communicate with a corresponding first valve body low pressure chamber 413. A second valve body oil control chamber corresponding to the one of the plurality of piston assemblies is communicated with the second distribution upper half ring groove 360, so a second check valve core corresponding to the one of the plurality of piston assemblies controls a corresponding second valve body high pressure chamber to be disconnected from a corresponding second valve body low pressure chamber.

The oil with high pressure flows through the high-pressure oil passage, the corresponding first valve body high pressure chamber 412, and the first valve body low pressure chamber 413, and then enters a piston chamber 110 corresponding to the one of the plurality of piston assemblies, so a piston 600 corresponding to the one of the plurality of piston assemblies is pushed to move downward, a volume of a piston chamber 110 corresponding to the one of the plurality of piston assemblies increases. The piston chamber 110 corresponding to the one of the plurality of piston assemblies drives the main shaft 200 to perform positive circular motion until the one of the plurality of piston assemblies reaches a lowermost position of the plurality of piston assemblies. Specifically, a flow direction of the oil with high pressure is as follows: the oil with high pressure enters the valve plate high pressure ring groove 141 from the first high-pressure oil passage section 131, then enters the corresponding first valve body high pressure chamber 412 through the corresponding first high pressure through hole 136, and then flows from the corresponding first valve body low pressure chamber 413 and enters the corresponding piston chamber 110.

When the one of the plurality of piston assemblies is in the lowermost position of the plurality of piston assemblies, the main shaft 200 and the rotating shaft 300 forward rotate 180 degrees, the corresponding first valve body oil control chamber 411 is communicated with the first distribution lower half ring groove 350, the oil with low pressure flows into the corresponding first valve body oil control chamber 411, so the first check valve core 420 corresponding to the one of the plurality of piston assemblies controls the corresponding first valve body high pressure chamber 412 to be disconnected from the corresponding first valve body low pressure chamber 413.

The second valve body oil control chamber corresponding to the one of the plurality of piston assemblies is communicated with the second distribution lower half ring groove 370, at this time, the oil with high pressure flows into the second valve body oil control chamber corresponding to the one of the plurality of piston assemblies, and the second check valve core 520 corresponding to the one of the plurality of piston assemblies controls the corresponding second valve body high pressure chamber to communicate with the corresponding second valve body low pressure chamber. Under thrust of other piston assemblies of the plurality of piston assemblies and under inertial force of the main shaft, the one of the plurality of piston assemblies moves upward, the volume of the piston chamber 110 corresponding to the one of the plurality of piston assemblies decreases. Oil in the piston chamber 110 corresponding to the one of the plurality of piston assemblies passes through the corresponding second valve body high pressure chamber and the second valve body low pressure chamber and flows out from the low-pressure oil passage to realize a periodic movement of the one of the plurality of piston assemblies. Specifically, the direction of the oil in the piston chamber 110 is as follows: the oil in the piston chamber 110 corresponding to the one of the plurality of piston assemblies passes through the corresponding second valve body high pressure chamber, the corresponding second valve body low pressure chamber, the corresponding first low pressure through hole 138, the valve plate low pressure ring groove 142 and flows out from the first low pressure oil section.

Periodic movement of the plurality of piston assemblies makes the main shaft 200 to forward rotate. The radial piston hydraulic device distributed by the pilot operated check valves is configured to convert hydraulic energy into mechanical energy.

When the radial piston hydraulic device distributed by the pilot operated check valves is a hydraulic pump, the high-pressure oil passage is connected to a high pressure oil tank or a hydraulic load and the high-pressure oil passage is configured as an oil outlet channel. The low-pressure oil passage is connected to a low pressure oil tank and the low-pressure oil passage is configured as an oil inlet channel.

The main shaft 200 reversely rotates to drive one of the plurality of piston assemblies to move downward from an uppermost position of the plurality of piston assemblies, and a volume of a corresponding piston chamber 100 increases to form a vacuum space, and a pressure in the corresponding piston chamber 110 is lower than a pressure of the low pressure oil tank.

At this time, a second valve body oil control chamber corresponding to the one of the plurality of piston assemblies is communicated with the second distribution lower half ring groove 370. A second check valve core corresponding to the one of the plurality of piston assemblies controls a corresponding second valve body high pressure chamber to communicate with a corresponding second valve body low pressure chamber. The first valve body oil control chamber 411 corresponding to the one of the plurality of piston assemblies is communicated with the first distribution lower half ring 350. A first check valve core 420 corresponding to the one of the plurality of piston assemblies controls a corresponding first valve body high pressure chamber 412 to be disconnected from a corresponding first valve body low pressure chamber 413. Oil in the low pressure oil tank flows through the first low-pressure oil passage section 132, the valve plate low pressure ring groove 142, the corresponding first lower pressure through holes 138, the corresponding second valve body low pressure chamber, and the corresponding second valve body high pressure chamber, and enters the one of the plurality of piston assemblies until the one of the plurality of piston assemblies moves to the lowermost position of the plurality of piston assemblies. During a process where the one of the plurality of piston assemblies is moved from the uppermost position to the lowermost position of the plurality of piston assemblies, the main shaft 200 drives the rotating shaft 300 to reversely rotate 180 degrees.

The main shaft 200 continues to reversely rotates 180 degrees. The one of the plurality of piston assemblies moves upward and the volume of the corresponding piston chamber 110 decreases and the pressure in the corresponding piston chamber increase. The pressure in the corresponding piston chamber is greater than a pressure of the high pressure oil tank or a pressure of the hydraulic load. At this time, the first valve body oil control chamber 411 corresponding to the one of the plurality of piston assemblies is communicated with the first distribution upper half ring groove 340. The first check valve core 420 corresponding to the one of the plurality of piston assemblies controls a corresponding first valve body high pressure chamber 412 to communicate with a corresponding first valve body low pressure chamber 413. The second valve body oil control chamber corresponding to the one of the plurality of piston assemblies is communicated with the second distribution upper half ring 360. The second check valve core 520 corresponding to the one of the plurality of piston assemblies controls a corresponding second valve body high pressure chamber to be disconnected from a corresponding second valve body low pressure chamber. The oil in the corresponding piston chamber 110 flows through the corresponding first valve body low pressure chamber 413 and the corresponding first valve body high pressure chamber 412, the corresponding first high pressure through holes, and valve plate high pressure ring groove, and enters the high pressure oil tank or the hydraulic load to discharge the oil in the corresponding piston chamber.

The main shaft 200 reversely rotates to drive the plurality of piston assemblies to move. The plurality of piston chambers 110 suck up the oil with low pressure and discharge the oil with high pressure. The radial piston hydraulic device distributed by the pilot operated check valves is configured to convert mechanical energy into hydraulic energy.

The above descriptions are only optional embodiments of the present disclosure, so the scope of implementation of the present disclosure is not limited accordingly. That is, equivalent changes and modifications made according to the protection scope of the present disclosure and the contents of the specification should still be fall within the protection scope of the present disclosure.

What is claimed is:

1. A radial piston hydraulic device distributed by pilot operated check valves, comprising:

a housing;

a plurality of piston assemblies;

a main shaft;

a rotating shaft;

first pilot operated check valves having a same number with the plurality of piston assemblies and one-to-one corresponding to the plurality of piston assemblies; and second pilot operated check valves having a same number with the plurality of piston assemblies and one-to-one corresponding to the plurality of piston assemblies;

wherein the housing comprises a plurality of piston chambers, a rotating shaft chamber, a high-pressure oil passage, and a low-pressure oil passage;

wherein each of the plurality of piston assemblies is slidable up and down in a corresponding piston chamber of the plurality of piston chambers;

wherein the main shaft is rotatably connected to the housing and is connected to the plurality of piston assemblies in a transmission way;

wherein the rotating shaft is rotatably mounted in the rotating shaft chamber and is fixedly connected to the main shaft; a control oil groove, a pressure relief oil groove, a first distribution ring groove, and a second distribution ring groove are provided on an outer periphery of the rotating shaft; the control oil groove is communicated with the high-pressure oil passage; the pressure relief oil groove is communicated with the low-pressure oil passage; the first distribution ring groove is divided into a first distribution upper half ring groove and a first distribution lower half ring groove; the second distribution ring groove is divided into a second distribution upper half ring groove and a second distribution lower half ring groove; the control oil groove is communicated with the first distribution upper half ring groove and the second distribution lower half ring groove; the pressure relief oil groove is communicated with the first distribution lower half ring groove and the second distribution upper half ring groove;

wherein each of the first pilot operated check valves comprises a first check valve body and a first check valve core; each first check valve body comprises a first valve body oil control chamber, a first valve body high pressure chamber, and a first valve body low pressure chamber; each first check valve core is movably mounted in a corresponding first check valve body and is configured to control on-off between a corresponding first valve body high pressure chamber and a corresponding first valve body low pressure chamber; each first valve body low pressure chamber is communicated with a corresponding piston chamber of the plurality of piston chambers; each first valve body high pressure chamber is communicated with the high-pressure oil passage; and each first valve body oil control chamber is alternately communicated with the first distribution upper half ring groove and the first distribution lower half ring groove;

wherein each of the second pilot operated check valves comprises a second check valve body and a second check valve core; each second check valve body comprises a second valve body oil control chamber, a second valve body high pressure chamber, and a second valve body low pressure chamber; each second check valve core is movably mounted in a corresponding second check valve body and is configured to control on-off between a corresponding second valve body high pressure chamber and a corresponding second valve body low pressure chamber; each second valve body high pressure chamber is communicated with a corresponding piston chamber of the plurality of piston chambers; each second valve body low pressure chamber is communicated with the low-pressure oil passage; each second valve body oil control chamber is alternately communicated with the second distribution upper half ring groove and the second distribution lower half ring groove.

2. The radial piston hydraulic device distributed by the pilot operated check valves according to claim 1, wherein the rotating shaft comprises two first connecting oil holes and two second connecting oil holes extending along an axial direction of the rotating shaft; and a first one of the first connecting oil holes communicates the control oil groove with the first distribution upper half ring groove; a second one of the first connecting oil holes communicates the control oil groove with the second distribution lower half ring groove; a first one of the second connecting oil holes communicates the pressure relief oil groove with the first distribution lower half ring groove; a second one of the second connecting oil holes communicates the pressure relief oil groove with the second distribution upper half ring groove.

3. The radial piston hydraulic device distributed by the pilot operated check valves according to claim 1, wherein the housing comprises a housing body and a valve plate; the main shaft is rotatably mounted the housing body and extends from a front end face of the housing body; the plurality of piston chambers are arranged on an outer periphery of the housing body; the valve plate is fixed to a rear end of the housing body; the rotating shaft chamber is defined in the valve plate and runs through the valve plate from front to rear.

4. The radial piston hydraulic device distributed by the pilot operated check valves according to claim 3, wherein the housing body comprises a first high-pressure oil passage section and a first low-pressure oil passage section; the valve plate comprises a second high-pressure oil passage section communicated with the first high-pressure oil passage section and a second high-pressure oil passage section communicated with the first low-pressure oil passage section; the first high-pressure oil passage section and the second high-pressure oil passage section form the high-pressure oil passage; the first low-pressure oil passage section and the second low-pressure oil passage section form the low-pressure oil passage.

5. The radial piston hydraulic device distributed by the pilot operated check valves according to claim 4, wherein a valve plate high pressure ring groove and a valve plate low pressure ring groove are provided on an outer periphery of the valve plate; a bottom wall of the valve plate high pressure ring groove defines a liquid resistance installation hole communicated with the control oil groove; a bottom wall of the valve plate low pressure ring groove defines a low pressure flow hole communicated with the pressure relief oil groove; the valve plate high pressure ring groove and the liquid resistance installation hole form the second high-pressure oil passage section; the valve plate low pressure ring groove and the low pressure flow hole form the second high-pressure oil passage section.

6. The radial piston hydraulic device distributed by the pilot operated check valves according to claim 5, wherein the housing body comprises first oil control holes and first high pressure through holes; each of the first oil control holes is communicated with a corresponding first valve body oil control chamber; each of the first high pressure through holes communicates the valve plate high pressure ring groove with a corresponding first valve body high pressure chamber; the valve plate comprises second oil control holes communicated with the first oil control holes; the second oil control holes correspond to the first distribution ring groove; the housing body further comprises third oil control holes communicated with the second valve body oil control chamber and a first low pressure through holes communicated the valve plate low pressure ring groove with each second valve body low pressure chamber; the valve plate further comprises fourth oil control holes communicated with the third oil control holes; the fourth oil control holes correspond to the second distribution ring groove.

7. The radial piston hydraulic device distributed by the pilot operated check valves according to claim 1, wherein each first check valve body comprises a first movable chamber, each first check valve core comprises a first valve core column, a first valve core block fixed on a first end of the first valve core column, and a second valve core block fixed on a second end of the first valve core column; each first valve core column is movably sleeved in a corresponding first movable chamber and drives a corresponding first valve core block and a corresponding second valve core block to move synchronously;

wherein each first valve core block is arranged in a corresponding first valve body oil control chamber and each first valve core block divides the corresponding first valve body oil control chamber into two first valve body oil control sub-chambers; each second valve core block is arranged in a corresponding first valve body high pressure chamber and is movable between an open position and a close position of the corresponding first valve body high pressure chamber; each first check valve core further comprises a first valve core elastic piece; each first valve core elastic piece is sandwiched between a corresponding first valve core block and a chamber wall of a corresponding first valve body oil control chamber;

wherein each second check valve body comprises a second movable chamber; each second check valve core comprises a second valve core column, a third valve core block fixed on a first end of the second valve core column, and a fourth valve core block fixed on a second end of the second valve core column; each second valve core column is movably sleeved in a corresponding second movable chamber and drives a corresponding third valve core block and a corresponding fourth valve core block to move synchronously;

wherein each third valve core block is arranged in a corresponding second valve body oil control chamber and each third valve core block divides the corresponding second valve body oil control chamber into two second valve body oil control sub-chambers; each fourth valve core block is arranged in a corresponding second valve body high pressure chamber and is movable between an open position and a close position of the corresponding second valve body high pressure chamber; each second check valve core further comprises a second valve core elastic piece; each second valve core elastic piece is sandwiched between a corresponding third valve core block and a chamber wall of a corresponding second valve body oil control chamber.

8. The radial piston hydraulic device distributed by the pilot operated check valves according to claim 3, wherein the main shaft comprises a first main shaft section, a second main shaft section, a third main shaft section, and a fourth main shaft section; the first main shaft section, the second main shaft section, the third main shaft section, and the fourth main shaft section are connected in sequence; the first main shaft section is connected to the rotating shaft and drives the rotating shaft to rotate synchronously; the second main shaft section is eccentric; a double-row cylindrical roller bearing is arranged on an outer periphery of the second main shaft section; an outer ring of the double-row cylindrical roller bearing is connected to the plurality of piston assemblies; a third main shaft section bearing is arranged on an outer periphery of the third main shaft section; the fourth main shaft section extends out of the housing body.

9. The radial piston hydraulic device distributed by the pilot operated check valves according to claim 8, wherein each of the piston assemblies comprises a piston, a piston slipper, and a piston return ring; each piston is up and down slidably connected in a corresponding piston chamber; a top end of each piston slipper is sleeved in a corresponding piston; a bottom end of each piston slipper abuts against the outer ring of the double-row cylindrical roller bearing; each piston return ring is sleeved on the bottom end of a corresponding piston slipper; each piston slides up and down in the corresponding piston chamber through a corresponding piston slipper and a corresponding piston return ring to drive the main shaft to rotate; or, the main shaft rotates to drive each piston to slide up and down in the corresponding piston chamber through the corresponding piston slipper and the corresponding piston return ring.

10. An operating method of a radial piston hydraulic device distributed by pilot operated check valves, applied to the radial piston hydraulic device distributed by the pilot operated check valves according to claim 1, wherein when the radial piston hydraulic device distributed by the pilot operated check valves is a hydraulic motor, the high-pressure oil passage is connected to a pressure oil source; the high-pressure oil passage is an oil inlet channel, and the low-pressure oil passage is an oil outlet channel;

when one of the plurality of piston assemblies is in am uppermost position of the plurality of piston assemblies, a corresponding first valve body oil control chamber is communicated with the first distribution upper half ring groove; a second valve body oil control chamber corresponding to the one of the plurality of piston assemblies is communicated with the second distribution upper half ring groove; a first check valve core corresponding to the one of the plurality of piston assemblies controls a corresponding first valve body high pressure chamber to communicate with a corresponding first valve body low pressure chamber; a second check valve core corresponding to the one of the plurality of piston assemblies controls a corresponding second valve body high pressure chamber to be disconnected from a corresponding second valve body low pressure chamber; oil with high pressure flows through the high-pressure oil passage, the corresponding first valve body high pressure chamber, and the first valve body low pressure chamber, and then enters a corresponding piston chamber, so a piston corresponding to the one of the plurality of piston assemblies is pushed to move downward, a volume of a corresponding piston chamber increases; the corresponding piston chamber drives the main shaft to perform positive circular motion until the one of the plurality of piston assemblies reaches a lowermost position of the plurality of piston assemblies;

when the one of the plurality of piston assemblies is in the lowermost position of the plurality of piston assemblies, the main shaft and the rotating shaft forward rotate 180 degrees, the corresponding first valve body oil control chamber is communicated with the first distribution lower half ring groove; the second valve body oil control chamber corresponding to the one of the plurality of piston assemblies is communicated with the second distribution lower half ring groove; the first check valve core corresponding to the one of the plurality of piston assemblies controls the corresponding first valve body high pressure chamber to be disconnected from the corresponding first valve body low pressure chamber; the second check valve core corresponding to the one of the plurality of piston assemblies controls the corresponding second valve body high pressure chamber to communicate with the corresponding second valve body low pressure chamber; under thrust of other piston assemblies of the plurality of piston assemblies and under inertial force of the main shaft, the one of the plurality of piston assemblies moves upward, the volume of the corresponding piston chamber decreases; the oil in the corresponding piston chamber passes through the corresponding second valve body high pressure chamber and the second valve body low pressure chamber and flows out from the low-pressure oil passage to realize a periodic movement of the one of the plurality of piston assemblies;

periodic movement of the plurality of piston assemblies makes the main shaft to forward rotate.

11. An operating method of a radial piston hydraulic device distributed by pilot operated check valves, applied to the radial piston hydraulic device distributed by the pilot operated check valves according to claim 1, wherein when the radial piston hydraulic device distributed by the pilot operated check valves is a hydraulic pump, the high-pressure oil passage is connected to a high pressure oil tank or a hydraulic load and the high-pressure oil passage is configured as an oil outlet channel; the low-pressure oil passage is connected to a low pressure oil tank and the low-pressure oil passage is configured as an oil inlet channel;

wherein the main shaft reversely rotates to drive one of the plurality of piston assemblies to move downward from an uppermost position of the plurality of piston assemblies, a volume of a corresponding piston chamber increases to form a vacuum space, and a pressure in the corresponding piston chamber is lower than a pressure of the low pressure oil tank; a second valve body oil control chamber corresponding to the one of the plurality of piston assemblies is communicated with the second distribution lower half ring groove; a second check valve core corresponding to the one of the plurality of piston assemblies controls a corresponding second valve body high pressure chamber to communicate with a corresponding second valve body low pressure chamber; the first valve body oil control chamber corresponding to the one of the plurality of piston assemblies is communicated with the first distribution lower half ring; a first check valve core corresponding to the one of the plurality of piston assemblies controls a corresponding first valve body high pressure chamber to be disconnected from a corresponding first valve body low pressure chamber; oil in the low pressure oil tank flows through the low-pressure oil passage, the corresponding second valve body low pressure chamber, and the corresponding second valve body high pressure chamber and enters the one of the plurality of piston assemblies until the one of the plurality of piston assemblies moves to a lowermost position of the plurality of piston assemblies; during a process where the one of the plurality of piston assemblies is moved from the uppermost position to the lowermost position of the plurality of piston assemblies, the main shaft drives the rotating shaft to reversely rotate 180 degrees;

wherein the main shaft continues to reversely rotates 180 degrees; the one of the plurality of piston assemblies moves upward and the volume of the corresponding piston chamber decreases and the pressure in the corresponding piston chamber increase; the pressure in the corresponding piston chamber is greater than a pressure of the high pressure oil tank or a pressure of the hydraulic load; a first valve body oil control chamber corresponding to the one of the plurality of piston assemblies is communicated with the first distribution upper half ring groove; the first check valve core corresponding to the one of the plurality of piston assemblies controls a corresponding first valve body high pressure chamber to communicate with a corresponding first valve body low pressure chamber; the second valve body oil control chamber corresponding to the one of the plurality of piston assemblies is communicated with the second distribution upper half ring; the second check valve core corresponding to the one of the plurality of piston assemblies controls a corresponding second valve body high pressure chamber to be disconnected from a corresponding second valve body low pressure chamber; the oil in the corresponding piston chamber flows through the corresponding first valve body low pressure chamber and the corresponding first valve body high pressure chamber, and enters the high pressure oil tank or the hydraulic load to discharge the oil in the corresponding piston chamber;

wherein the main shaft reversely rotates to drive the plurality of piston assemblies to move; the plurality of piston chambers suck up the oil with low pressure and discharge the oil with high pressure.

* * * * *